United States Patent [19]

Hirabayashi et al.

[11] Patent Number: 4,939,554

[45] Date of Patent: Jul. 3, 1990

[54] SHEET CONVEYANCE APPARATUS

[75] Inventors: Tsugio Hirabayashi; Masahito Kuratsune; Kohji Yoshie; Hiroyuki Ari; Yoshikazu Maekawa; Masaru Ushio, all of Hachioji; Masayuki Miyazaki, Tama; Chiharu Kobayashi, Tokyo, all of Japan

[73] Assignee: Konica Corporation, Tokyo, Japan

[21] Appl. No.: 126,615

[22] Filed: Nov. 30, 1987

[30] Foreign Application Priority Data

| | | | |
|---|---|---|---|
| Dec. 1, 1986 | [JP] | Japan | 61-286261 |
| Jan. 20, 1987 | [JP] | Japan | 62-11162 |
| Jul. 21, 1987 | [JP] | Japan | 62-181680 |
| Jul. 21, 1987 | [JP] | Japan | 62-181675 |

[51] Int. Cl.[5] ..... G03G 15/00; B65H 7/00

[52] U.S. Cl. ..... 355/317; 271/9

[58] Field of Search ..... 355/3 SH, 14 SH, 24, 355/26, 8, 3 TR, 14 TR, 309, 317, 319, 211; 271/9

[56] References Cited

U.S. PATENT DOCUMENTS

| | | | |
|---|---|---|---|
| 4,129,377 | 12/1978 | Miyamoto et al. | 355/14 SH |
| 4,392,741 | 7/1983 | Inuzuka et al. | 355/14 R |
| 4,416,534 | 11/1983 | Klager | 355/14 SH |
| 4,437,754 | 3/1984 | Idstein | 355/3 SH X |
| 4,451,136 | 5/1984 | Tanioka et al. | 355/3 SH X |
| 4,770,403 | 9/1988 | Katsumata et al. | 271/9 |

FOREIGN PATENT DOCUMENTS

| | | | |
|---|---|---|---|
| 59-223635 | 12/1984 | Japan | 271/9 |
| 60-195555 | 10/1985 | Japan . | |

*Primary Examiner*—Joan H. Pendegrass

*Attorney, Agent, or Firm*—Finnegan, Henderson, Farabow, Garrett and Dunner

[57] ABSTRACT

An electrophotographic copying apparatus has increased speed in recording sheet conveyance where the conveying path from the sheet feed cassette to the photosensitive member is relatively long. The sheet conveyance apparatus is constructed to equalize the line speed of the photosensitive member, the feed speed of the recording sheet and the conveying speed of the recording sheet. A plurality of sheets serially fed out from a sheet tray are concurrently transported along the sheet path. A sheet is fed out from the sheet tray in response to a timing reference signal generated in response to the scanning operation for a previously fed out sheet.

10 Claims, 37 Drawing Sheets

FIG. 10-a
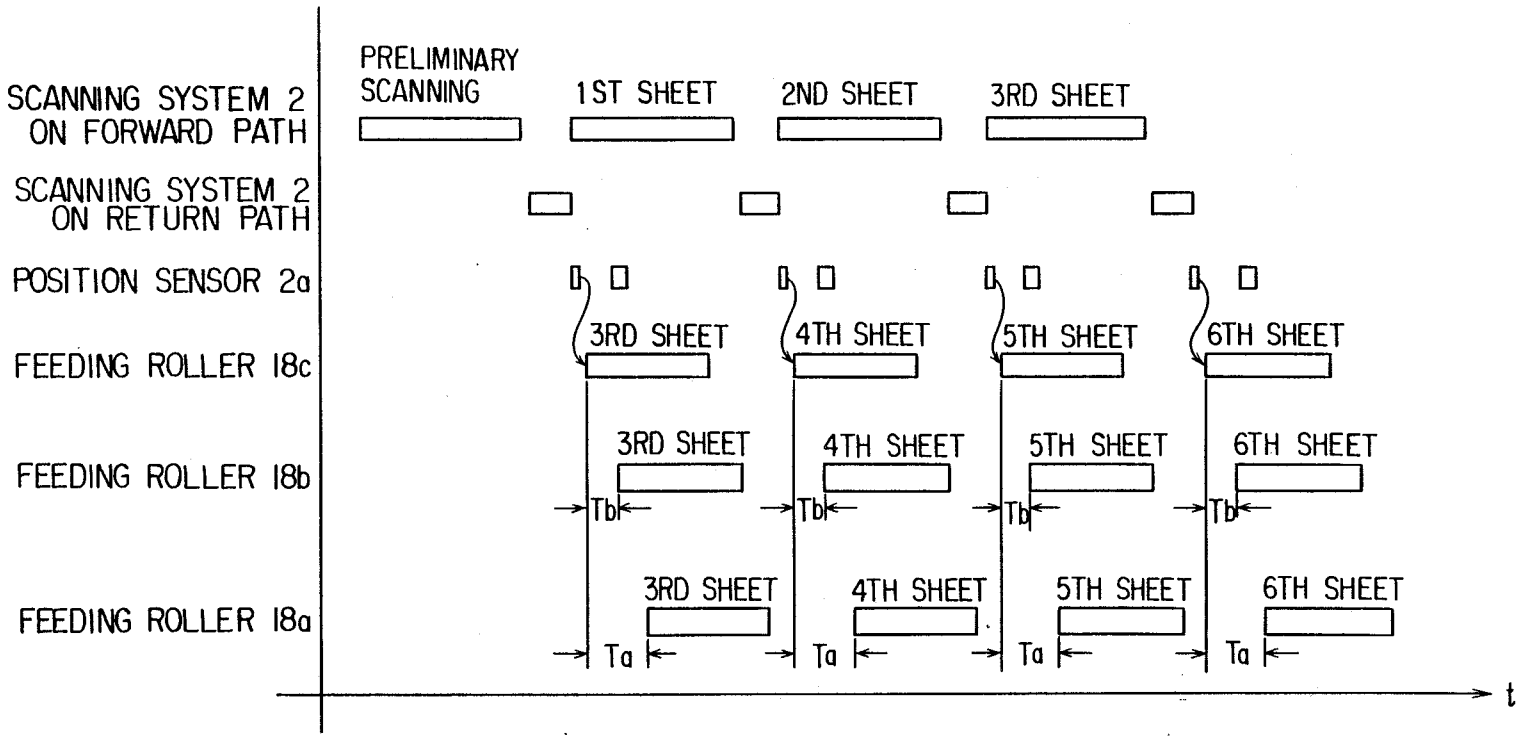

FIG. 10-b
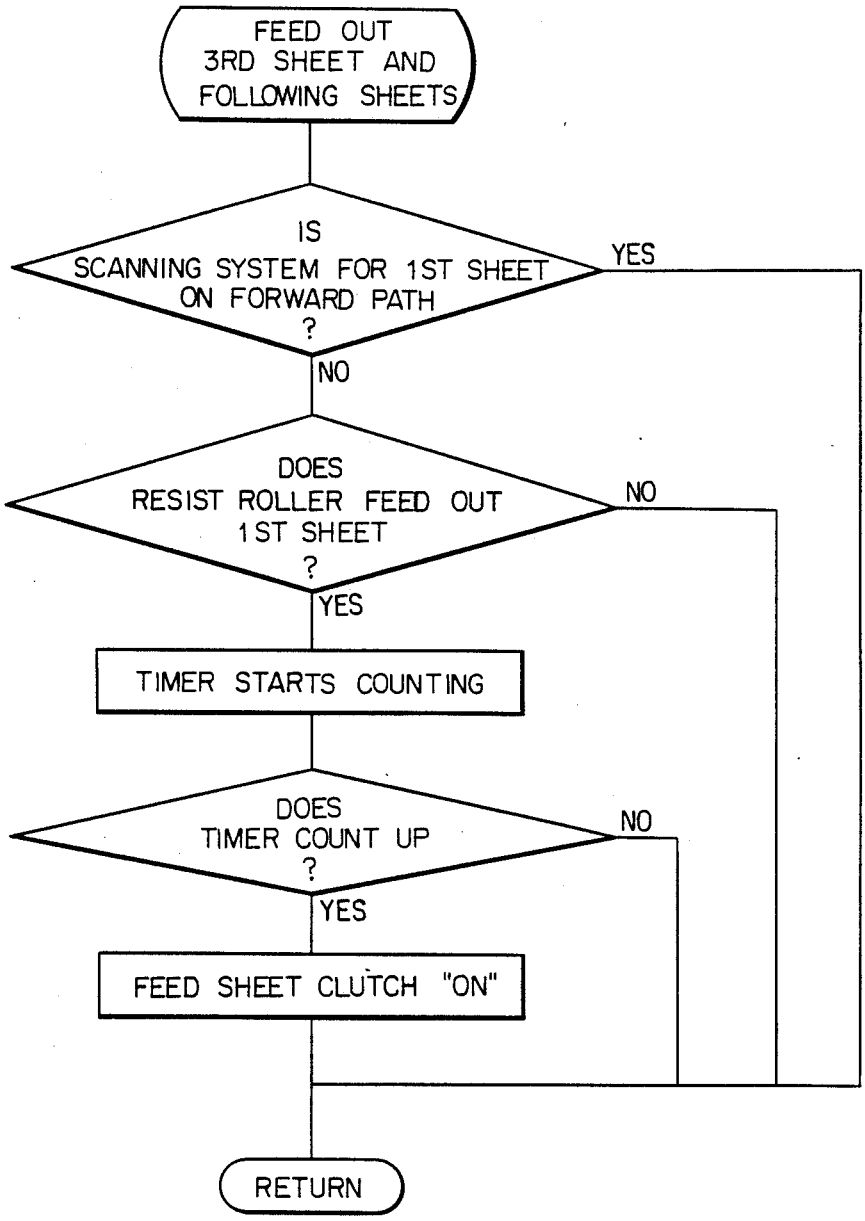

SHEET CONVEYANCE APPARATUS

BACKGROUND OF THE INVENTION

The present invention relates to a recording sheet conveyance apparatus used in an image recording apparatus or an image printing apparatus such as an electrophotographic copying apparatus.

Conventionally, the line speed of a photosensitive member and the feed speed of a copying sheet are determined independently of each other for a recording sheet conveyance apparatus of an electrophotographic copying apparatus. Thus, it is possible to increase the copying speed adequately, even by starting the feed of a new sheet from the feed sheet cassette at a high speed after the sheet is fed to the photosensitive member.

Such a conventional system, however, has encountered a problem such as the reduction of the sheet feeding speed where copying sheets of three different sizes have to be fed selectively, since the larger-sized copying sheet has a longer feed time than the smaller-sized copying sheet, thereby causing a reduction of the copying speed.

As a countermeasure against this problem, it has been devised to increase the conveyance speed and feed speed of the copying sheet or starting the feed of the next sheet from the feed sheet cassette before the feed of a sheet to the photosensitive member is completed. However, increasing the feed speed and conveyance speed of the copying sheet or starting the feed of next sheet from the feed sheet cassette before the feed of a sheet to the photosensitive member is completed is found to cause a new problem where the succeeding sheet runs into the preceding sheet from behind while the preceding sheet is waiting to be synchronized with the turn of the photosensitive member.

The present invention also relates to a feed sheet apparatus, especially a feed sheet apparatus for recording sheets constituting an independent unit from the copying apparatus.

In general, a feed sheet apparatus for feeding sheets to an apparatus such as a copying apparatus is incorporated in the copying apparatus.

More particularly, as seen from the general construction shown in FIGS. 39 and 40, a plurality of feed sheet cassettes 300 are disposed so that one contacts another, respectively, on the feed sheet side in the frame of the copying apparatus from the sheet feeding apparatus. The operation unit of the copying apparatus is first instructed of the stage from which the sheets are to be supplied, whereby the timer counter is set through sheet feeding sensor S1 for the conveyance of the sheets. The sheet feeding clutch is actuated to transmit the drive force of the sheet feeding motor, and only the setting of the timer needs to be done.

In the case of a conventional sheet feeding apparatus having the above-described mechanism, when the rear end of a sheet has left the sheet refeeding roller the succeeding sheet from the feed sheet cassette is sent to the waiting position of the sheet at a high speed by the sheet refeeding roller. In the case of the sheet feeding apparatus according to the present invention, however, the sheet is fed at a speed equal to or higher than the sheet feeding speed of the sheet refeeding roller.

When control of the speed in sending out the sheet carrier (including the control of the stop of the sheet) is lacking, there is the possibility that the succeeding sheet runs into the preceding sheet at the restart stage, in the sheet feeder which is changed freely with a sheet conveyance apparatus installed separately from the frame of the copying apparatus.

Further, the present invention relates to a sheet feeder which is separated from the copying apparatus and in which the sheet conveyance speed is made to coincide with the processing speed of the copying apparatus.

In general, for the sheet conveyance speed in the sheet feeder which is separated from the copying apparatus, the sheet feed speed is increased in feeding the sheet to the copying apparatus from the sheet feeder to let the sheet arrive at the sheet refeed roller, i.e., the resist roller of the copying apparatus, and then the speed is equalized to the speed of the image carrying member to form the desired image.

In the conventional system as described above, however, the sheet has to be sent to the copying apparatus at a high speed at each copying, so that, when the copying apparatus has to be operated at a high speed such as at 70 sheets/minute, the sheet conveyance path or sheet path becomes longer, and thus the copying apparatus is unable to fully exert its high-speed function, thereby causing the problem that the copying speed is governed by the sheet conveyance speed of the sheet feeder.

A further object of the present invention is to provide a sheet feeder which is free of this problem of the conventional system and enables high-speed copying by equalizing the sheet conveyance speed of the sheet feeder to the speed of revolution of the image carrying member so that the sheet can be allowed to be present even in the sheet conveyance path.

SUMMARY OF THE INVENTION

The present invention has been made taking into consideration the aforementioned points, aiming at increasing the conveyance speed of the recording sheet in the electrophotographic copying apparatus, especially the conveyance speed of the recording sheet in the electrophotographic copying apparatus where the conveyance path ranging from the feed sheet cassette to the photosensitive member is relatively long. The sheet feeding mechanism according to the invention is so constructed to equalize the line speed of the photosensitive member, the feed speed of recording sheet and the conveyance speed of the recording sheet.

A further object of the invention is to arrange, through a simple control, a plurality of recording sheets in the sheet feeding path for the purpose of enhancing the copying speed and the printing speed. In order to achieve this object, the invention is constructed so that the recording sheet is fed out, and is synchronized with the traveling movement of the scanning exposure optical system that gives exposure to the photosensitive member. The recording sheet is also preferably synchronized with the traveling movement of the scanning exposure optical system that gives exposure to preceding recording sheets preceding in a recording sheet conveyance apparatus that feeds recording sheets from a feed sheet cassette to the photosensitive member.

The present invention aiming at solving the aforementioned problems relates to a sheet feeder, which is internally divided into at least two stages, installed detachably on the sheet feeding side of a copying apparatus to use the recording sheets. The sheet feeder comprises a feed sheet lift with a feed sheet carrier which is driven by its own driving unit, a feed sheet roller in contact with the uppermost one of the sheets on the feed sheet carrier of the feed sheet lift, a sheet feeding unit with a sheet separator designed to separate the sheets transferred by the feed sheet roller and a sheet conveyance unit to feed the sheets separated by the sheet feeding unit to the copying apparatus.

Because of the adoption of the above-described system, the sheet conveyance apparatus according to the present invention can be separated from the frame of the copying apparatus at the time of packing for shipment to make its transportation easier. Besides, the feed sheet lift is provided with a carrier capable of carrying the sheets of various sizes and quantities, so that the size of the sheet to be fed can be changed freely.

BRIEF DESCRIPTION OF THE DRAWINGS

FIG. 10-*a* is a schematic diagram illustrating one example of sheet feeding order.

FIG. 10-*b* is a flow chart showing sheet feeding timing.

DETAILED EMBODIMENT OF THE INVENTION

The embodiment of the present invention will be explained in the following with reference to the relevant drawings.

Figure 1:
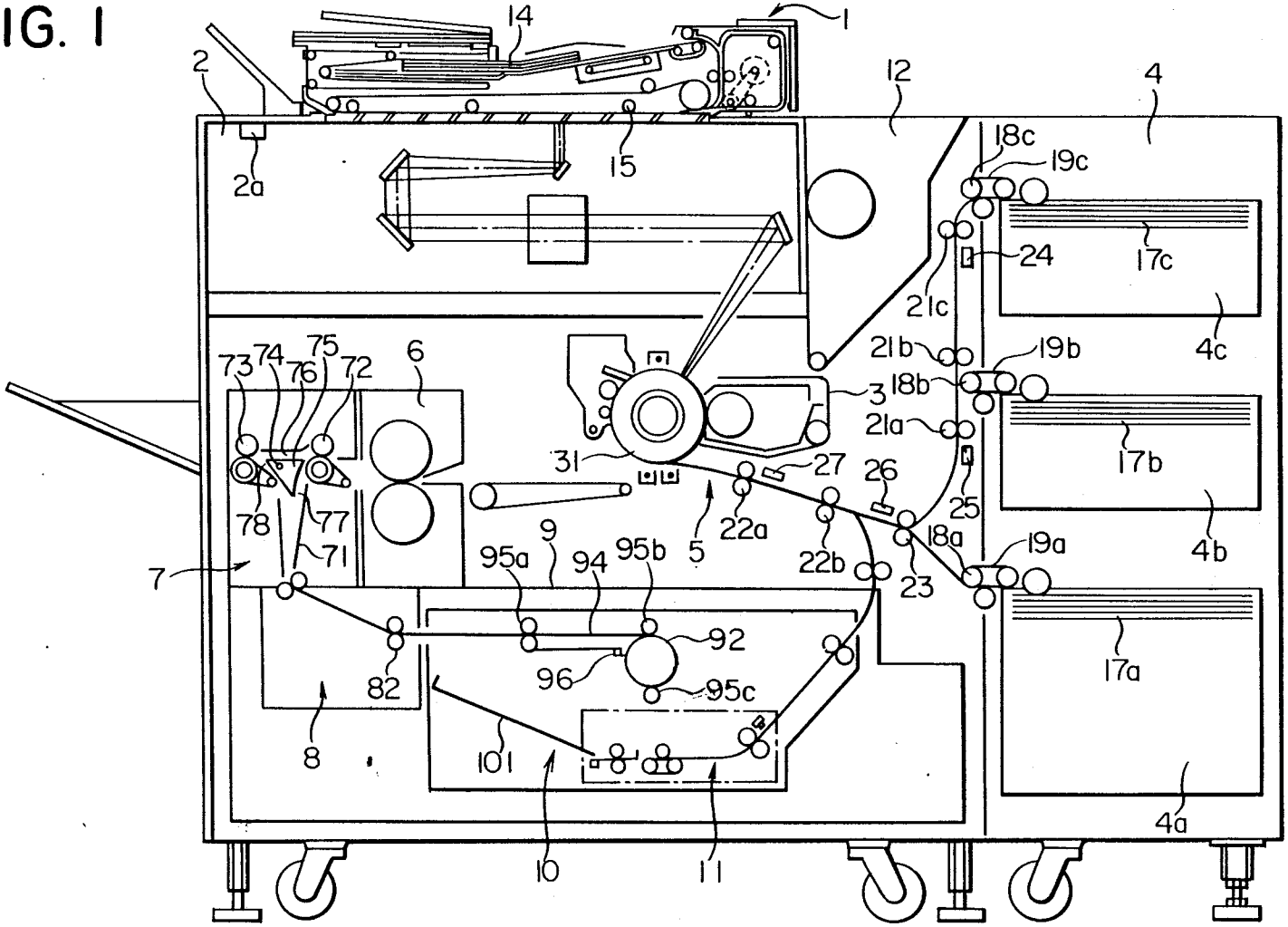
FIG. 1 is a simplified front view of the automatic two-sided copying apparatus incorporating the recording sheet conveyance apparatus according to the present invention.
Figure 2:
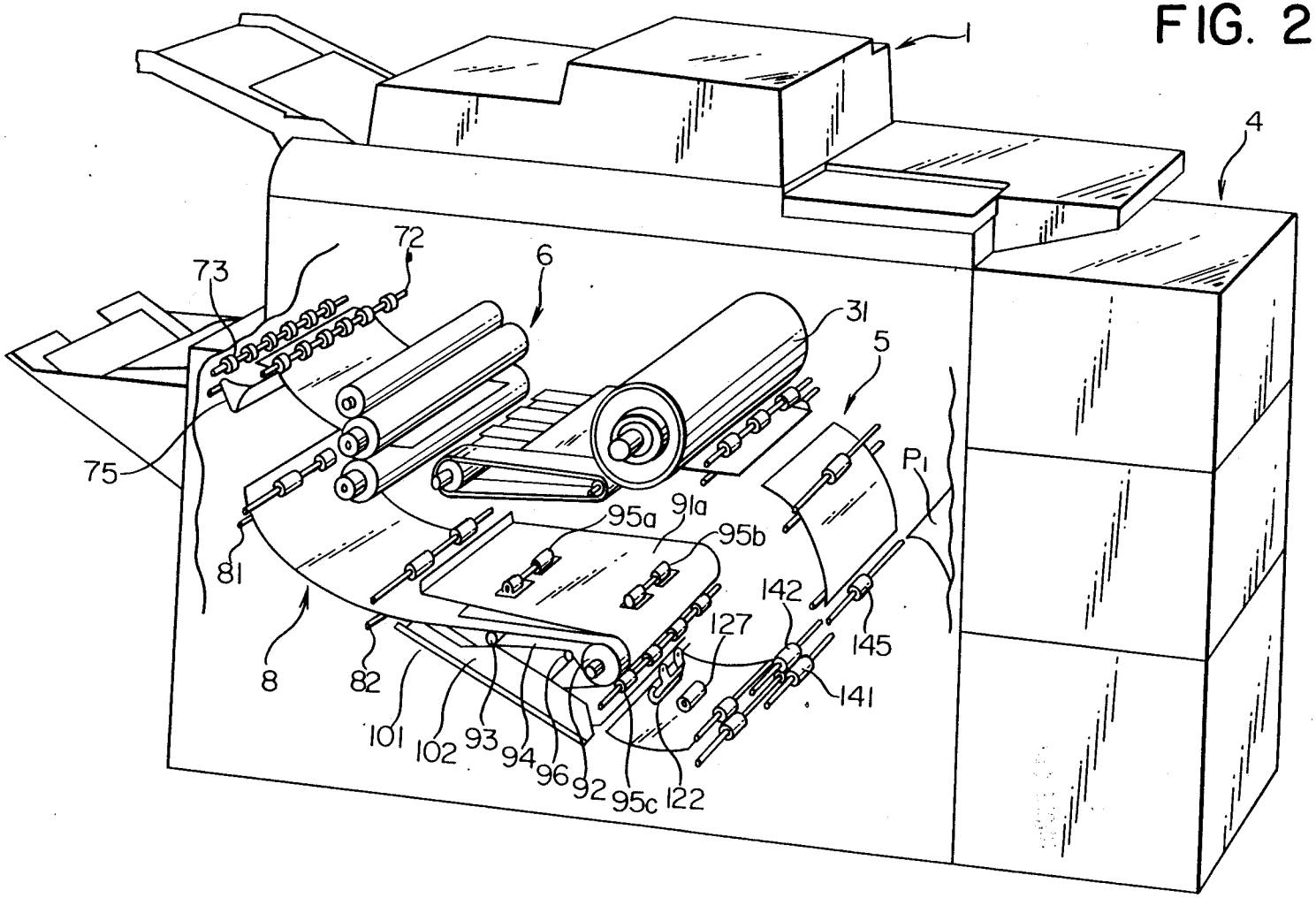
FIG. 2 is a simplified perspective view of the automatic two-sided copying apparatus utilizing the recording sheet conveyance apparatus according to the present invention.

FIG. 1 is a simplified front view of an automatic two-sided copying apparatus utilizing the recording sheet conveyance apparatus according to the present invention. FIG. 2 is a perspective view of an automatic two-sided copying apparatus utilizing the recording sheet conveyance apparatus according to the present invention.

In the system shown in FIG. 1, the original document 14 placed on the automatic original document feeding unit 1 is fed onto the platen glass 15 by the original document feeding unit 1 when the copying operation is started. The original document 14 placed on the platen glass 15 is exposed by the scanning exposure optical system 2, and the latent image corresponding to the original document 14 is formed on the surface of the photosensitive member 31. The latent image is transformed into the toner image on the surface of the photosensitive member 31 by the photosensitive member image forming unit 3. The toner image is transferred onto the copying sheet 17 supplied from the copying sheet feeding unit 4, i.e., the paper feeding unit or PFU, which will be explained later, and the transferred toner image is heated so as to be fixed by the fixer 6. After undergoing the fixing process, the copying sheet with the fixed image is discharged out of the copying apparatus by the upstream rollers 72 and 73.

The feeding process of the copying sheet 17 will be explained with reference to FIGS. 3 and 4. Here, the refeeding process of the copying sheet will also be explained, since the refeeding process is concerned with two-sided copying.

As explained in the above, the photosensitive member 31 receives the supply of copying sheets 17 from the copying sheet feeding unit 4. The copying sheet feeding unit 4 is provided with three feed sheet cassettes 4*a* through 4*c* designed to contain the copying sheets of three different sizes 17*a* through 17*c*. The copying sheets 17*a* through 17*c* are sent out, respectively, from the feed sheet cassettes 4*a* through 4*c* by means of the feeding rollers 18*a* through 18*c* and the feeding belts 17*a* through 19*c*. The feeding rollers 18*a* through 18c are combined with the feeding belts 19*a* through 19*c* so that the uppermost sheet of any one of the stacks of copying sheets 17*a* through 17*c* can be sent out one by one towards the left direction shown in FIG. 3 as the rollers 18*a* through 18*c* turn clockwise while the feeding belts 19*a* through 19*c* are in contact with the copying sheets 17*a* through 17*c*. FIG. 3 shows the process by which the copying the copying sheet 17*a* is sent out towards the left direction shown in FIG. 3 from the feed sheet cassette 4*a* by the feeding roller 18*a* and the feeding belt 19*a*.

Figure 3:
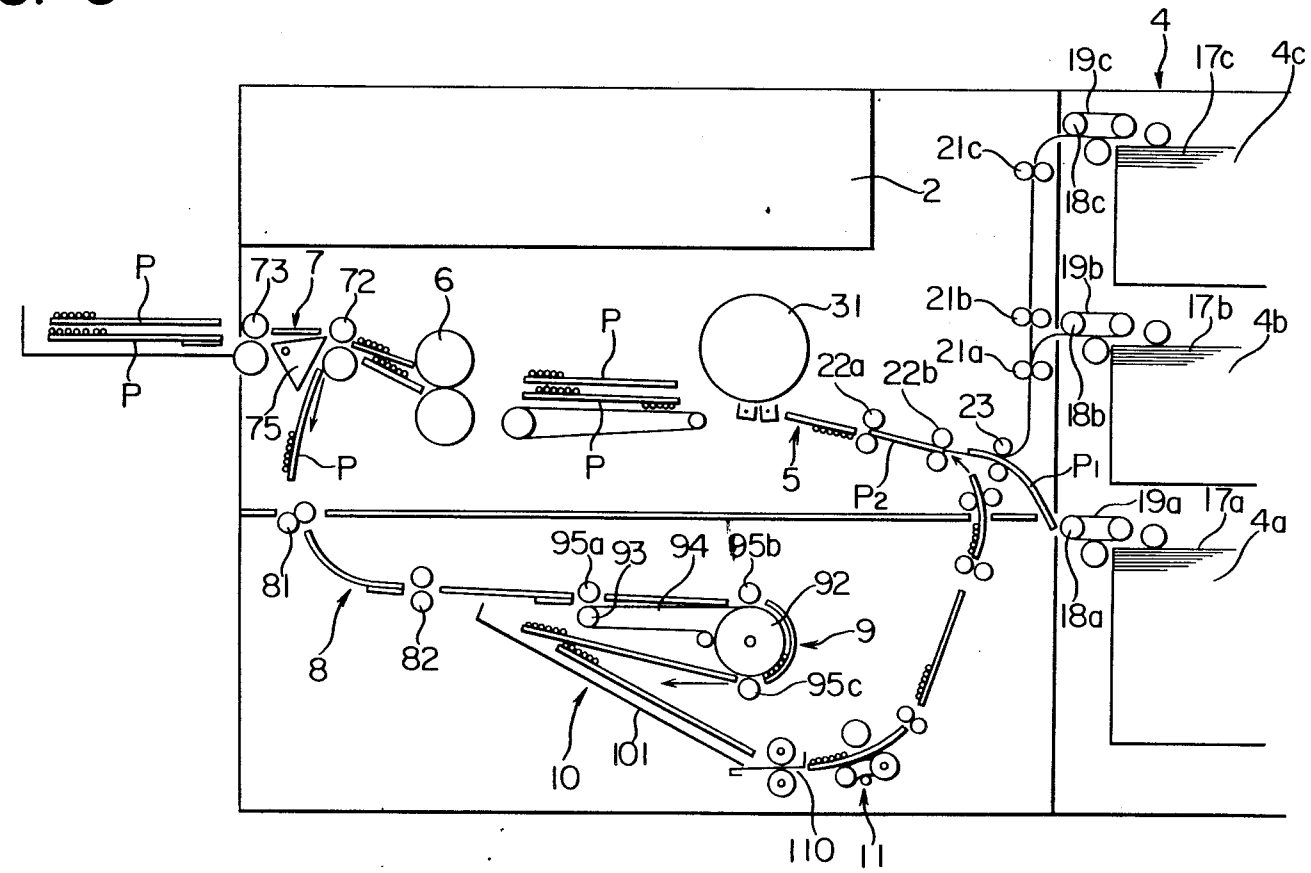
FIG. 3 is a simplified front view explaining the sheet feeding route in the automatic two-sided copying apparatus shown in FIG. 1.

The copying sheets 17*a* through 17*c* sent out by the feeding belts 19*a* through 19*c* are conveyed to the position P2 as shown in FIG. 3 by the feed sheet rollers 21, 22*a* and 22*b*. From the position P2, the copying sheet speed is synchronized with the turning speed of the photosensitive member 31 and sent out to have the toner image transferred thereon from the surface of the photosensitive member 31. In the case of one-sided copying, the image is fixed by heating with the fixer 6, and the copying sheet is discharged out of the copying apparatus by the upstream rollers 72 and 73 to complete the copying operation. In the case of two-sided copying, the copying sheet is transferred as described in the following.

The sheet reversing-sheet discharging switching unit 7 designed to switch the course of the copying sheet either for the sheet discharging route 76 to which the copying sheet carrying the fixed image moves in the forward direction or for the guiding route 77 for transferring the copying sheet to the guide plate 71 for two-sided copying or the reversing or the discharging is provided on the downstream side of the copying sheet conveyance unit 5. The sheet reversing-sheet discharging switching unit 7 consists of the guide plate 71, an upstream roller 72, a downstream roller 73, a moving branched member 75 with an inverted triangular cross section that pivots on shaft 74 and an electromagnetic solenoid (not shown in the drawing). The moving branched member 75 having the inverted triangular cross section forms the sheet discharging route 76 with the upper surface of the moving branched body 75, the introduction route 77 communicating with the guide plate 71 through its lower right side surface and the reversing-discharging route 78 communicating with the guide plate 71 through its lower left side surface, respectively.

Figure 4:
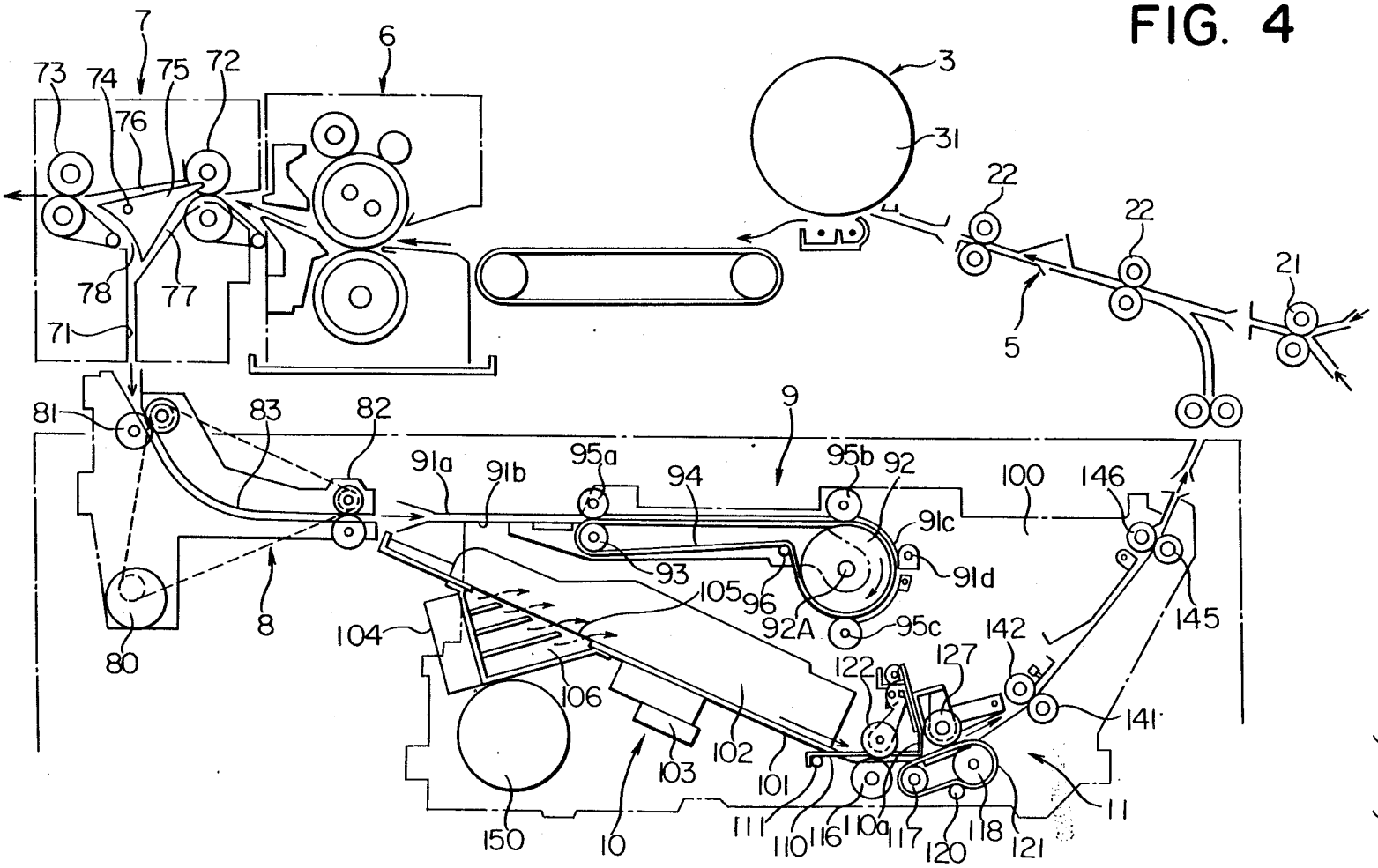
FIG. 4 is a simplified front view explaining the sheet refeeding route in the automatic two-sided copying apparatus shown in FIG. 1

As for the moving branched member 75, its right end, as shown in FIG. 4, moves up and down when driven by the drive unit (not shown in the drawing), such as the electromagnetic solenoid to open the introduction route 77 and close the sheet discharging route 76 or to close the introduction route 77 and open the sheet discharging route 76 when the switching of the route is required. The lower end of the moving branched member 75 approaches close to the guiding plate 71 located at the outside of the introduction route 77, which is on the right side of the part shown in FIG. 4, leaving a small clearance that is large enough to permit the passage of only a portion of a sheet when the moving branched member 75 has caused the introduction route 77 to open as described above, so that the lower end of the moving branched member is separated from the guide plate 71 at the outside of the sheet reversing-discharging route 78, which is on the left side of the part shown in FIG. 4.

As described above, when the moving branched member 75 has caused the introduction route 77 to open, the copying sheet 17 is prevented from moving towards the reverse direction or towards the introduction route 77 from the branched conveyance unit 8 on the downstream side. That is, the copying sheet 17 passes the right end of the moving branched member 75 to move down into the introduction route 77 and continues to move past the lower end of the moving branched member 75 and the guide plate 71 to reach the branched conveyance unit 8. Then, the copying sheet 17 is prevented from moving in the reverse direction or towards the sheet reversing-discharging switching unit 77 when the copying sheet 17 is moved in the reverse direction or towards the sheet reversing-discharging route 78 by being switched back to the sheet reversing-discharging switching unit 7 by the reverse turn of the roller 81 that is capable of turning either in the normal or the reverse direction.

The copying sheet 17 conveyed downwardly past the sheet reversing-discharging switching unit 7 as shown in FIG. 4 is further conveyed to the reversing conveyance unit 9 by being guided with the rollers 81 and 82 of the branched conveyance unit 8 and the guide plate 83. The rollers 81 and 82 are driven with a motor 80 capable of turning in the normal and the reverse directions. As described above, the reverse turn of the motor 80 causes the copying sheet 17 to be conveyed in the reverse direction to the sheet reversing-discharging route 78 by switching back the copying sheet 17 to the sheet reversing-discharging switching unit 7.

The copying sheet 17 reaches reversing conveyance unit 9 and is guided into the clearance between the guide plate 91 and the guide plate 91*b*. The copying sheet 17 runs on the upper surface of the guide plate 91*b*, is inserted between the endless belt 94 and rollers 95*a* and 95*b* for further conveyance and is turned over along the reversing guide 91*c*. After being reversed, the copying sheet 17 is discharged towards the left direction as shown in FIG. 4 by the roller 95*c* under the lower surface of pulley 92.

A plurality of endless belts 94 extend between pulley 92 and pulley 93. The rollers 95*a* and 95*b* are supported with the guide plate 91*a* through their shafts and are pressed against one of the endless belts 94 so as to be turned following the movement of the endless belt 94.

The roller 95c is pressed against the endless belt 94 so as to be turned following the movement of the endless belt. The tension roller 96 not only adjusts the tension of the endless belt 94 which extends between pulley 92 and pulley 93 but also causes the endless belt 94 to be adequately wound around the pulley 92 so that the copying sheet 17 released from the roller 87 can be prevented from following the endless belt 94.

The guide plate 91a is supported with a shaft 98 located on the right side of the pulley 92 as shown in FIG. 4 so as to be able to oscillate around the shaft 98. This not only facilitates the treatment of the jamming that may occur between the guide plate 91a and guide plate 91b but also enables the weight of the guide plate 91a to be applied properly onto the rollers 95a and 95b so that the rollers can be pressed properly against the endless belt 94. The guide plate 91b is pivotally supported with the drive shaft 92a of the pulley 92. This facilitates checking the conditions of the copying sheet 17 in stacker 10 located under the guide plate 91b and the treatment of jamming.

The stacker 10 is located under the reversing conveyance unit 9 as shown in FIG. 4 and is provided with a stacker base plate 101 inclined towards lower right side as shown in FIG. 4, a sheet width adjusting plate 102 as shown in FIG. 2 capable of being adjusted according to the size of copying sheet 17, an adjusting plate moving device 103 and a ventilation fan 104.

The adjusting plate moving device 103 consists of a motor, a gear train and two rack members (both are not shown in the drawing) engaging with a pinion and capable of moving in the direction along the width of the copying sheet 17 and enables the sheet width adjusting plate 102 to move when the size of the copying sheet 17 is set. The ventilation fan 104 for jetting the air flow towards upper right direction as shown in FIG. 4 from a jet nozzle 106 is provided at the bottom of the base plate of the stacker 101. The air flow jetted from the air jet nozzle 106 flows under the copying sheet 17 falling from the reversing conveyance unit 9 to let the copying sheet slide on the surface of the stacker base plate 101 by the air flow. In this manner, the frictional resistance of the sheet can be reduced, whereby the inclination of the stacker base plate 101 can be made smaller.

Figure 5:
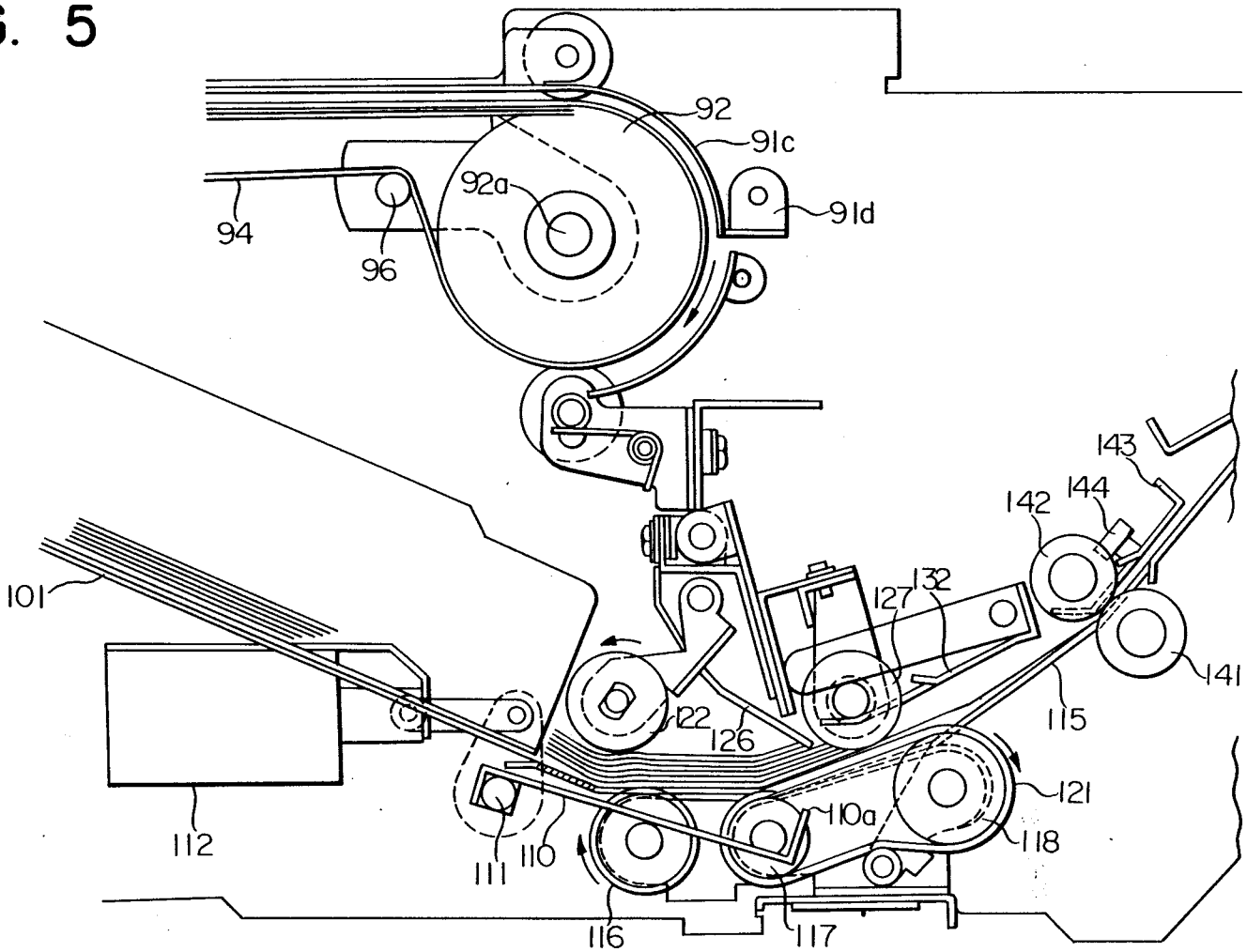
FIG. 5 is also a simplified front view explaining the sheet refeeding route in the automatic two-sided copying apparatus shown in FIG. 1.

The stopper 110 of the sheet refeeding unit 11 is located at the lower end of inclined stacker base plate 101. The right end of the stopper 110 is bent to almost a right angle to form a dead-end surface 110a. The end of the copying sheet 17 that slides down the inclined surface of the stacker base plate 101 by the air flow and by the gravity comes to contact the deadend surface 110a. As shown in FIG. 5, the stopper 110 is driven by the electromagnetic solenoid 112 to turn around the shaft 111. A fixed guide plate 115 is located under the stopper 110 as shown in FIG. 5. There is an opening near the middle of the width of the fixed guide plate 115, and a roller 116 and a separating belt 121 project slightly through the opening. A pressure roller 122 capable of freely oscillating up and down from an upper position to a lower position shown in FIG. 5 is located above the fixed guide plate 115 and the pressure roller 122 is pressed against the roller 116 when the pressure roller 122 is disposed in the lower position.

The copying sheet 17 released from the reversing conveyance unit 9 moves down along the inclined surface of the stacker base plate 101 and slides on the surface of the stopper 110 until stopping at the dead-end surface 110a. The copying sheets 17 sent from the stacker 10 one by on following the preceding sheet are stacked on the stacker base plate 101 and the stopper 110, and the ends of the copying sheets 17 are turned up by coming into contact with the dead-end surface 110a.

Then, the stopper 110 turns clockwise by being driven with the sheet refeeding unit 112. Simultaneously, the pressure roller 122 is turned counterclockwise to move downwardly until being pressed against the uppermost one of the copying sheets 17 stacked on the stopper 110. When the stopper 110 has moved downwardly, the copying papers 17 stacked on the stopper 110 fall down. The fall of the copying sheets 17 causes the lowermost one of the copying sheets 17 to contact the surfaces of the fixed guide plate 115, the roller 116 and the separating belt 121. Simultaneously, the pressure roller 122 also moves down, so that the copying sheets 17 are pressed between the pressure roller 122 and the roller 116. In this case, the pressure roller 122 presses the copying sheets 17 by its empty weight.

Under the above-described condition, when the sheet refeed start signal is inputted, the roller 118 is driven to turn to cause the separating belt 121 to turn in the direction indicated with an arrow as shown in FIG. 4. Simultaneously, the roller 116 starts to turn. This cause the copying sheets 17 stacked on the fixed guide plate 115 pressed between the turning roller 116 and the pressure roller that moves following the roller 116 to be conveyed towards the right-side direction shown in FIG. 4 in order to be placed on the separating belt 121.

When the end of the copying sheet 17 placed on the separating belt 121 is conveyed towards slightly upper right direction (see FIG. 4) passing the bottom surface of the regulating plate 126, only the regulated number of the copying sheets 17 is permitted to pass the clearance formed between the regulating plate 126 and the separating belt 121. The copying sheets 17 exceeding the regulated number are prevented from proceeding by the regulating plate 126 to enter the waiting state. The copying sheets 17 past the clearance of the regulating plate 126 are pressed between the separating belt 121 moving towards upper right direction and a duplicate conveyance preventive roller 127 turning only clockwise, and only the lowermost one of the copying sheets 17 is sent out due to the frictional separating force acting between the separating belt 121 and the duplicate conveyance preventive roller 127.

Subsequently, the one copying sheet 17 further proceeds between the fixed guide plate 115 and the guide plate 132 and is conveyed further utilizing the pressure acting between the sheet feeding roller 141 and the sheet feeding roller 142 until the passage of the end of the copying sheet 17. The copying sheet 17 is conveyed further by the sheet feeding rollers 141 and 142 to pass between the sheet discharging lower rollers 145 and 146 as shown in FIG. 4 and is sent to the copying sheet conveyance unit 5. In this case, the roller 116 and the separating belt 121 stop or turn depending on the result of detection by the photosensor 144.

Then, the copying sheet 17 goes to the photosensitive member image forming unit 3 where the image is transferred onto the back of the copying sheet 17, has the image fixed by the fixer 6 and is discharged out of the copying apparatus passing the sheet reversing-discharging switching unit 76. In this manner, the copying on the back of the first copying sheet 17 through refeeding of the sheet is completed, and the refeeding of the next copying sheet 17 in the waiting state is started when the refeed start signal is inputted. From this point on, the above-described sheet refeeding procedure will be repeated.

In the case of the recording sheet conveyance apparatus such as one described in the foregoing, as means for increasing the copying speed by increasing the sheet feeding speed, the feeding roller 18, the feeding belt 19 and the sheet feeding roller 21 can be permitted to operate at higher speeds to enable the copying sheet 17 to be conveyed at a higher speed from the copying sheet supply unit 4 when the feed of the sheet to the photosensitive member 31 from the point P2 by the sheet feeding rollers 2a and 2b is completed. Also, as means for increasing the sheet feeding speed, the copying sheet supply unit 4 can start sending out the copying sheet 17 before the feed of sheet to the photosensitive member 31 from the point P2 by the sheet feeding rollers 22a, i.e., the resist roller, and 22b is completed. However, when the system is arranged so that the copying sheet 17 starts to come out from the copying sheet supply unit 4 before the supply of the sheet to the photosensitive member 31 from the point P2 by turning the feeding roller 18, the feeding belt 19 and the sheet feeding roller 21 at higher speeds, there exists the possibility that the copying sheet may run into the end of the succeeding copying sheet 17 that is waiting to be synchronized with the turn of the photosensitive member 31 at the point P2.

In the case of the recording sheet conveyance apparatus according to the present invention, however, the line speed or circumferential speed of the photosensitive member 31, the feeding speed of the copying sheet 17 by the feeding roller 18, the feeding belt 19, the roller 18 and the separating belt 121 and the conveyance speed of the copying sheet 17 by the sheet feeding roller 21, the sheet feeding rollers 22a and 22b, the sheet feeding roller 142 and the sheet discharging lower roller 145 are equalized.

Thus, when the line speed of the photosensitive member 31 is changed for reduced or enlarged copying, the feeding speed of the copying sheet 17 by the feeding roller 18, the feeding belt 19, the roller 118 and the separating belt 121 and the conveyance speed of the copying sheet 17 by the sheet feeding roller 31, the sheet feeding rollers 22a and 22b, the sheet feeding roller 142 and the sheet discharging lower roller 145 is also changed to match the line speed of the photosensitive member 31.

In this manner, when the line speed of the photosensitive member 31 and the feeding speed of the copying sheet 17 are equalized, the succeeding copying sheet 17 can be prevented from running into the preceding copying sheet at point P2 by controlling the system so that the succeeding or the next succeeding copying sheet 17 starts to be sent out when the feed of the sheet to the photosensitive member 31 from the point P2 by the sheet feeding rollers 22a and 22b is completed.

This arrangement is especially useful where it is required for the control of the conveyance to permit two to three copying sheets 17 to be present in the conveyance routes such as those between the feeding belt 19 and the feeding rollers 22a and 22b and between the separating belt 121 and the sheet feeding rollers 22a and 22b by arranging the system so that the copying sheet 17 starts to come out from the copying sheet supply unit 4 and the stopper 110 before the feed of the sheet from the point P2 is completed.

Furthermore, where the timing of the sheet feeding is required for shifting the image to provide the margin for the binding, the intervals of the copying sheets 17 can be equalized by changing the timing for sending out through feeding back such timing not only to the sheet feeding rollers 22a and 22b but also to the feeding roller 18 and the feeding belt 19.

Figure 6:
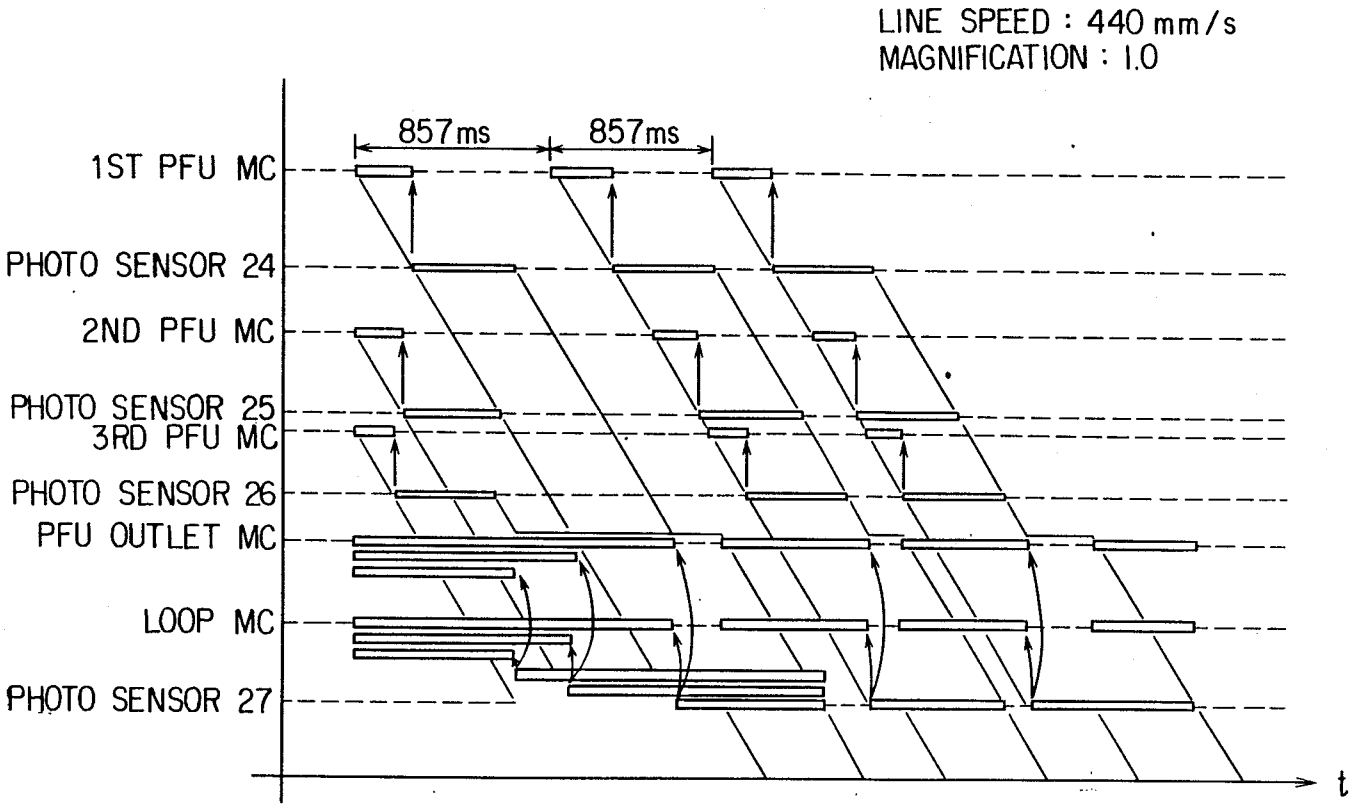
FIG. 6 is a timing chart explaining the process by which the recording sheet conveyance apparatus according to the present invention transfers a copying sheet.
Figure 7:
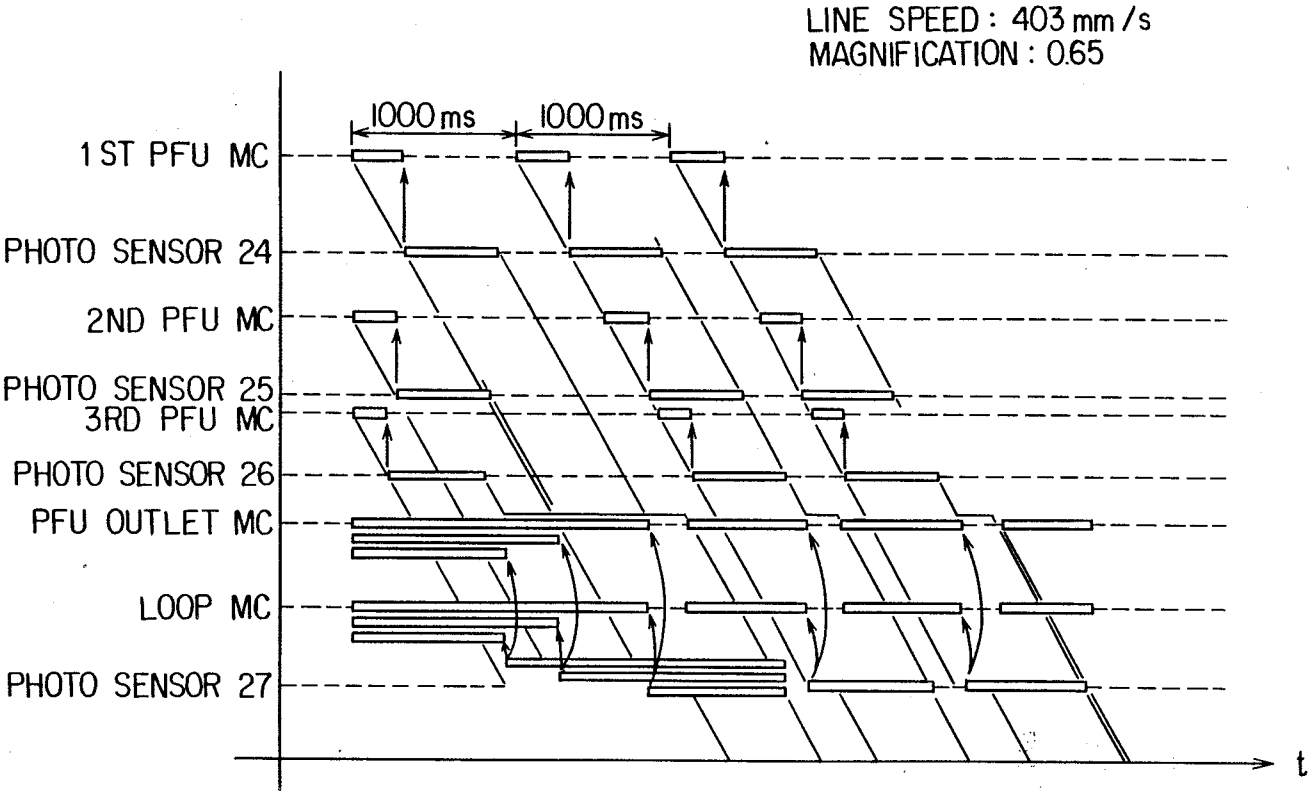
FIG. 7 is also a timing chart explaining the process by which the recording sheet conveyance apparatus according to the present invention transfers a copying sheet.

FIG. 7 shows the process of the movement of the copying sheet 17 where the line speed of the photosensitive member 31, that is, the feeding speed and the conveyance speed of the copying sheet 17 are set to 403 mm/s (copying magnification: 0.65–0.70). Similarly, FIG. 6 shows the process of the movement of the copying sheet 17 where the line speed of the photosensitive member 31, that is, the feeding speed and the conveyance speed of the copying sheet 17 are set to 440 mm/s (copying 1.55–0.71), and FIG. 8 shows the process of the movement of the copying sheet 17 where the line speed of the photosensitive member 31, that is, the feeding speed and the conveyance speed of the copying sheet 17 are set to 310 mm/s (copying magnification: 1.50–0.64).

Figure 8:
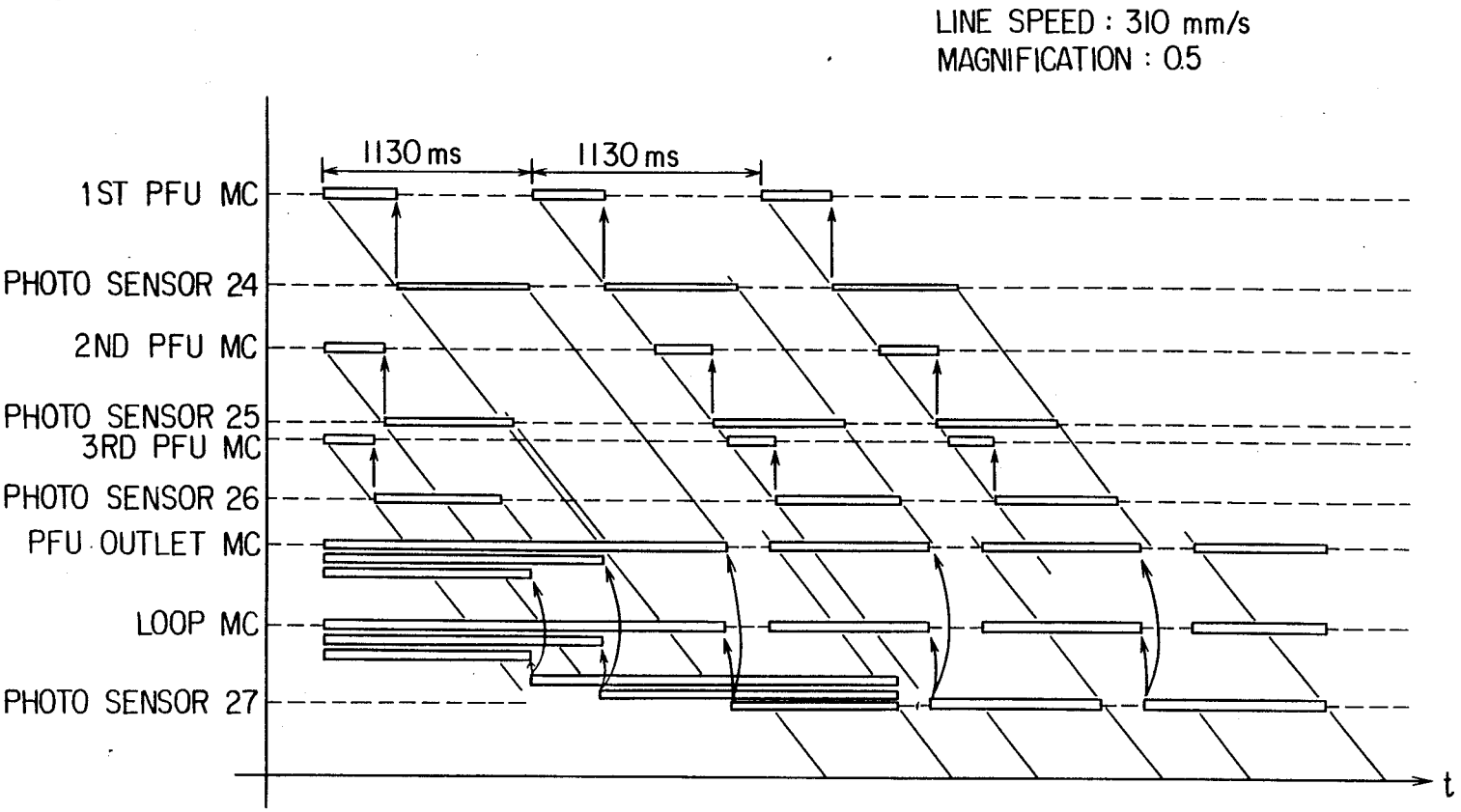
FIG. 8 is a further timing chart explaining the process by which the recording sheet conveyance apparatus according to the present invention transfers a copying sheet.

FIGS. 6, 7 and 8 show the condition of the movement of the copying sheet 17 in terms of the detection by the photosensors 24 through 27 as shown in FIG. 1 installed in conveyance routes and the operation of each microswitch MC (electromagnetic clutch). The figures show the timing for continuous feeding of an A4 size (letter size) sheet and each of them shows concurrently all the feed sheet timing for an upper, a middle and a lower stage cassette. In these figures, "1ST PFU MC" refers to the microclutch for intermittently controlling the drive of the feeding roller 18c and the feeding belt 10c; "2ND PFU MC" refers to the microclutch for intermittently controlling the drive of the feeding roller 18b and the feeding belt 19b; "3RD PFU·MC" refers to the OUTLET microclutch for intermittently controlling the drive of the sheet feeding roller 23; "LOOP MC" refers to the microclutch for intermittently controlling the drive of the sheet feeding roller 22b; and "Restart MC" refers to the microclutch for intermittently controlling the drive of the sheet feeding roller 22a.

Also, the drive motor A is the drive source of the feeding roller 18, feeding belt 19, sheet roller 21, sheet feeding roller 22 and sheet feeding roller 23, while the drive motor B is the drive source of the sheet feeding roller 22a and sheet feeding roller 22b.

Figure 9:
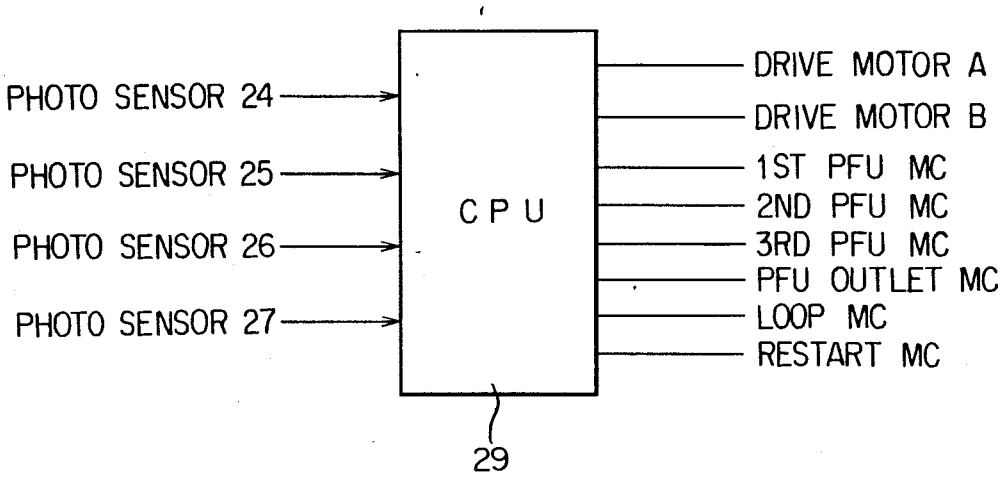
FIG. 9 is a block diagram showing the control circuit of the recording sheet conveyance apparatus according to the present invention.

The control of the drive of the microclutches MC and the control of the drive by the drive motors are accomplished through the CPU circuit 29 depending on the resulting of the detection by the photosensors 24 through 27 as shown in FIG. 9. FIGS. 6, 7 and 8 show the drive timings of the microclutches MC to be controlled by CPU circuit 29.

The movement of a sheet and the movement of each roller will be explained based on FIG. 6, referring to FIG. 1. The figure shows concurrently all the sheet feed timing for the upper, middle and lower cassettes on a feed sheet device. Therefore, the example of the upper cassette only will be explained. When the COPY button is pressed, 1st PFU MC, PFU OUTLET MC and LOOP MC are powered and rollers 18c, 19c, 23 and 22b are driven. Then, the sheet is fed out of the upper cassette by means of the rollers 18c and 19c and then passes the roller 21c and is detected by the photosensor 24. After the sheet is detected by the photosensor 24, 1st PFU MC is turned off and rollers 18c and 19c stop rotating. Thus, the sheet is transported by rollers 21c, 21b, and 21a, successively.

Rollers 21*a*, 21*b* and 21*c* keep rotating. When the leading edge of the sheet is detected by the photosensor 27, PFU OUTLET MC and LOOP MC are turned off and rollers 23 and 22*b* stop rotating. The sheet is transported again, being synchronized with the movement of images on the photosensitive member. The second and the third sheets are transported in the same manner. The timing for sheet feeding for the second and third sheets, however, will be explained later. In the case of sheet feeding from the middle cassette, sheet feeding is started by rollers 18*b* and 19*b* and then the 2nd PFU MC stops when photosensor 25 detects the sheet. The sheet, in this case, arrives at the position of photosensor 27 slightly earlier than in the upper cassette and then is transported to the photosensitive member through the timing. In the case of the upper cassette, the sheet is fed every 857 m while in the case of the middle and lower cassette, the sheet is fed with a slight delay so that the sheet from the middle or lower cassette has the same timing as that from the upper cassette. This will be explained later.

Next, the timing for feeding the copying sheet 17 is described using FIG. 10-*a*.

As mentioned above, the timing for feeding the copying sheet 17 by means of the sheet feeding roller 22 is synchronized with the rotation of the photosensitive member 31. This synchronization is performed based on the detection output of the position sensor 2*a* provided in the scanning exposure optical system 2. That is, the traveling position of the scanning exposure optical system 2 is detected by means of the position sensor 2*a*, and the position of the scanning exposure optical system 2 when the system 2 returns along the return path after moving along the forward path for the exposure is detected by means of the position sensor 2*a*. Thereby, the output from the sensor 2*a* serves as a timing reference for the sheet feeding roller 22 to send out the copying sheet 17.

The position of the scanning exposure optical system 2 when the system 2 returns along the return path after moving along the forward path for the exposure, as mentioned above, is detected by the position sensor 2*a* and the detection signal thus emitted also serves as a timing reference for the feeding rollers 18*a* through 18*c* to send out the copying sheets 17*a* through 17*c*.

More specifically, as shown in FIG. 10-*a*, the rotational driving of the feeding roller 18*a* is started based on a detection signal from the position sensor 2*a*. The rotation of the feeding roller 18*a* is stopped after the predetermined time, and in this duration the copying sheet 17*c* is sent out toward the left direction shown in FIG. 1 by means of the rotation of the feeding roller 18*a* and is then conveyed by the feeding roller 21 to the position P2. FIG. 10 describes the timing for sending out the third copying sheet by means of the feeding roller 18*c*. The first and second sheets are unconditionally sent out by means of the feeding roller 18*c* when a power switch is turned on or a size selection switch for the copying sheet 17 is manipulated.

In addition, to equalize the intervals for feeding the copying sheets 17*a* through 17*c*, the arrangement is such that feeding the succeeding sheets 17*a* through 17*c* is started following the dummy reading (prescanning) by the scanning exposure optical system 2 before the latent image is formed on the photosensitive member 31.

Accordingly, the timing for sending out the third copying sheet 17*c* by means of the feeding roller 18*c* is based on a position detection signal emitted from the position sensor 2*a* in the scanning exposure optical system 2 when the system 2 returns along the return path after moving the forward path for the dummy reading (prescanning).

The timing for sending out the fourth copying sheet 17*c* is based on the signal from the position sensor 2*a* in the scanning exposure optical system 2 when the system 2 returns along the return path after moving along the forward path for exposure of the first copying sheet. Similarly, the timing for sending out the fifth copying sheet 17*c* is based on the position signal from the position sensor 2*a* in the scanning exposure optical system 2 when the system 2 returns along the return path after moving along the forward path for exposure of the second copying sheet.

As described above, the timing for sending out the copying sheet 17 is determined every time based on the position signal emitted from the position sensor 2*a* in the scanning exposure optical system 2 when the system 2 returns along the return path after moving along the forward path for exposure of the second preceding sheet.

In regard to the lengths of paths from the feeding sheet cassettes 4*a* through 4*c* to the point P2 as shown in FIG. 1, the length of the conveyance path varies with respective feeding sheet cassettes 4*a* through 4*c*. Therefore, a variance of the feeding interval of each of the copying sheets 17*a*, 17*b*, and 17*c* may occur. The variance of the feeding interval due to the difference in the conveyance path length is eliminated with a timer as described hereinbelow.

The conveyance path length for the copying sheet 17*b* sent out from the feeding roller 18*b* to the position P2 is shorter than that of the copying sheet 17*c* sent out from the feeding roller 18*c*. Correspondingly, to delay the timing for feeding the copying sheet 17*b* in proportion to this difference in the conveyance path length, a signal from the position sensor 2*a* which has detected the return motion of the scanning exposure optical system 2 is delayed by a timer for the delay time Tb, and then the rotation of the feeding roller 18*b* is started by using this delayed signal as a reference.

The rotation of the feeding roller 18*b* which is stopped after the predetermined time, and the dummy reading (prescanning) by the scanning exposure optical system 2 which is based on the timing for feeding the third copying sheet 17*b*, as well as the description of the timing for feeding the subsequent fourth copying sheet 17*b*, etc. are the same as those of the above-mentioned feeding roller 18*c*.

The conveyance path length for the copying sheet 17*a* sent out from the feeding roller 18*a* to the position P2 is far shorter than that of the copying sheet 17*c* sent out from the feeding roller 18*c*. Correspondingly, to delay the timing for feeding the copying sheet 17*a* in proportion to this difference in the conveyance path length, a signal from the position sensor 2*a* which has detected the return motion of the scanning exposure optical system 2 is delayed by a timer for the delay time Ta, and then the rotation of the feeding roller 18*a* is started using this delayed signal as a reference.

The rotation of the feeding roller 18*a* which is stopped after the predetermined time, and the dummy reading (prescanning) by the scanning exposure optical system 2 which is based on the timing for feeding the third copying sheet 17*a*, as well as the description of the timing for feeding the subsequent fourth copying sheet 17c, etc. are the same as those of the above-mentioned feeding rollers 18c and 18b.

In some cases, such as where the margin for the binding is to be provided on the copying sheet 17, if the adjustment is made so as to delay the timing for sending out the copying sheet 17 by means of the sheet feeding roller 22, the timing for starting the rotation of the above-mentioned feeding rollers 18a through 18c is also delayed in accordance with this adjustment. Conversely, if the adjustment is made so as to advance the timing for feeding out the copying sheet 17 by means of the sheet feeding roller 22, the timing for starting the rotation of the above-mentioned feeding rollers 18a through 18c is also advanced in accordance with this adjustment.

The method for controlling the third sheet and thereafter continuous sheet feeding will be explained as follows, referring to the flow chart in FIG. 10-b. When the COPY button is pressed first, the feed sheet clutch is engaged and the first sheet is fed by feed sheet rollers 18 and 19. Next, after a prescribed time period from the completion of conveyance for the first sheet, the second sheet is fed. Then, when it is confirmed by the position sensor 2a that the movement of the optical system 2 for the first sheet is on the return path and the first sheet has been fed out by resist roller 22a, the timer is started. Then, after the prescribed time period, the feed sheet clutch is engaged again and the third sheet is fed. The fourth sheet and succeeding sheets are fed under the same control as that for the third sheet. When a preliminary scanning is provided, the 'FIRST SHEET' in a chart represents the preliminary scanning and the second sheet and succeeding sheet are fed out. In this case, the values determined in advance depending on the conditions, such as which step the sheet is fed from, the line speed of a photosensitive member, the sheet size, the image shift and so forth are stored as a value of time. They are set on the CPU in accordance with these conditions.

In this example, sheet feeding is started from the cassette that is ahead by three cassettes based on the detection of returning of scanning. However, the invention also includes the situation wherein sheet feeding is started from the cassette that is ahead by four or more cassettes for the longer sheet feeding path, or the sheet feeding is started from the cassette that is ahead by two cassettes for the shorter sheet feeding path, under the appropriate control.

As explained in the foregoing, according to the present invention, the line speed of the photosensitive member, the feeding speed and the conveyance speed of the recording sheet are equalized. This system enables an increase in the conveyance speed of the recording sheet in the electrophotographic copying apparatus, including the instance where the conveyance route from the feed sheet cassette to the photosensitive member is relatively large, such as the case of the electrophotographic copying apparatus.

The other embodiments of the present invention will be explained in the following with reference to the relevant drawings.

Figure 37:
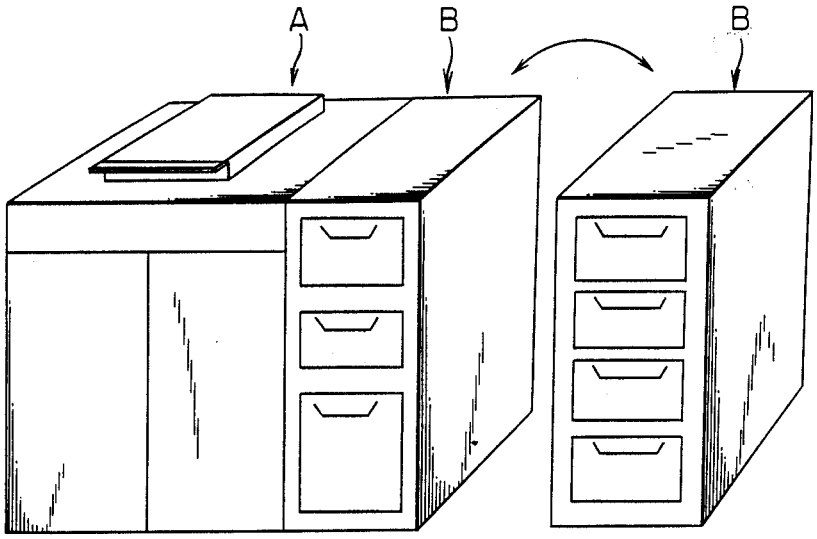
FIGS. 37 and 38 show simplified overall views of the sheet feeder according to the present invention designed as a separate unit.
Figure 38:
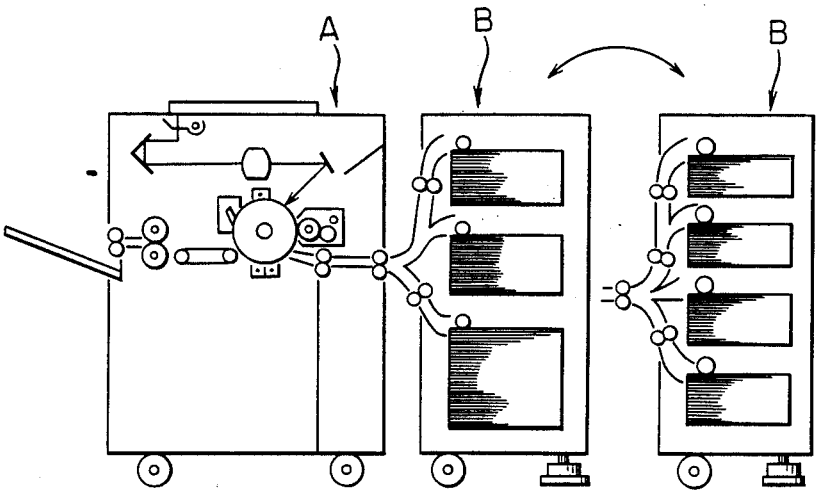
Figure 39:
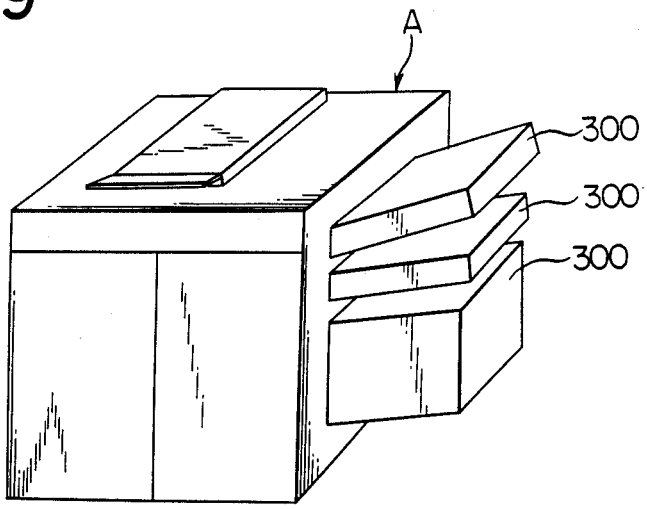
FIGS. 39 and 40 are views of conventional sheet feeders as integral parts of the copying apparatus, respectively.
Figure 40:
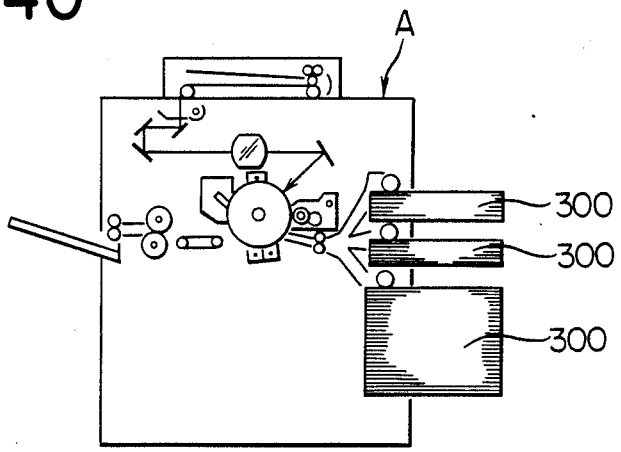

FIGS. 37 and 38 show a simplified general view of the sheet feeding unit B according to the present invention. The sheet feeding unit B is located on sheet feeding side of the copying apparatus A and is provided with a sheet carrier consisting of a least two stages, such as those which include three or four stages. Furthermore, the sheet feeding unit B can be connected integrally and flush with the copying apparatus A. Each sheet feeder within the sheet feeding unit B corresponds to the entrance to the recording sheet conveyance route of the copying apparatus A so that the sheets on each sheet carrier in the sheet feeding unit B can be fed into the copying apparatus A.

An automatic draft feeder (ADC) 14 is located on the draft carrier of the copying apparatus A.

The level and depth of the copying apparatus A are made equal to the level and depth of the sheet feeding unit B so that a useful plane is available when the copying apparatus A and the sheet feeding unit B are connected to each other.

To explain generally about the sheet feeding unit B, FIGS. 11 through 36 show the whole and various parts of the sheet feeding unit according to the present invention. The feeding unit is connected to the sheet feeding side of the copying apparatus A. The sheet feeding unit B comprises a rectangular frame 202 fabricated with square pipes 201. The frame 202 is internally divided into three stages, that is, an upper stage, a middle stage and a lower stage. The sheet feeding unit B further comprises arch-shaped rails 203 that are located at the internal bottom of each stage or between the bottom of each stage and the frame 202, a base plate 204 that is movable horizontally between the near side and the far side on the rails 203 and stoppers 205 provided at the far end of the frame so as to correspond with each of the stages.

Figure 11:
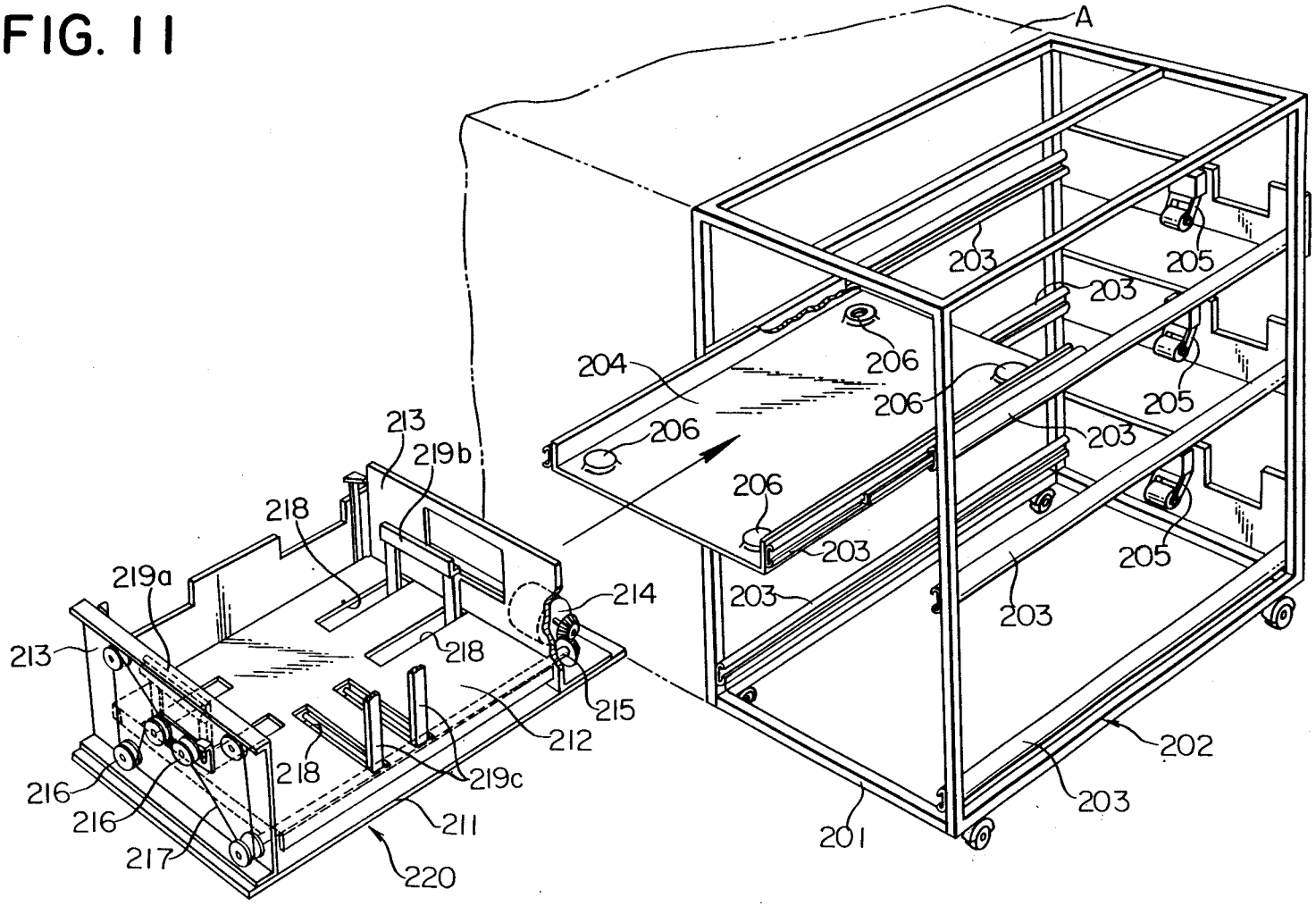
FIG. 11 is a simplified perspective view of a sheet feeding unit in accordance with the present invention.
Figure 12:
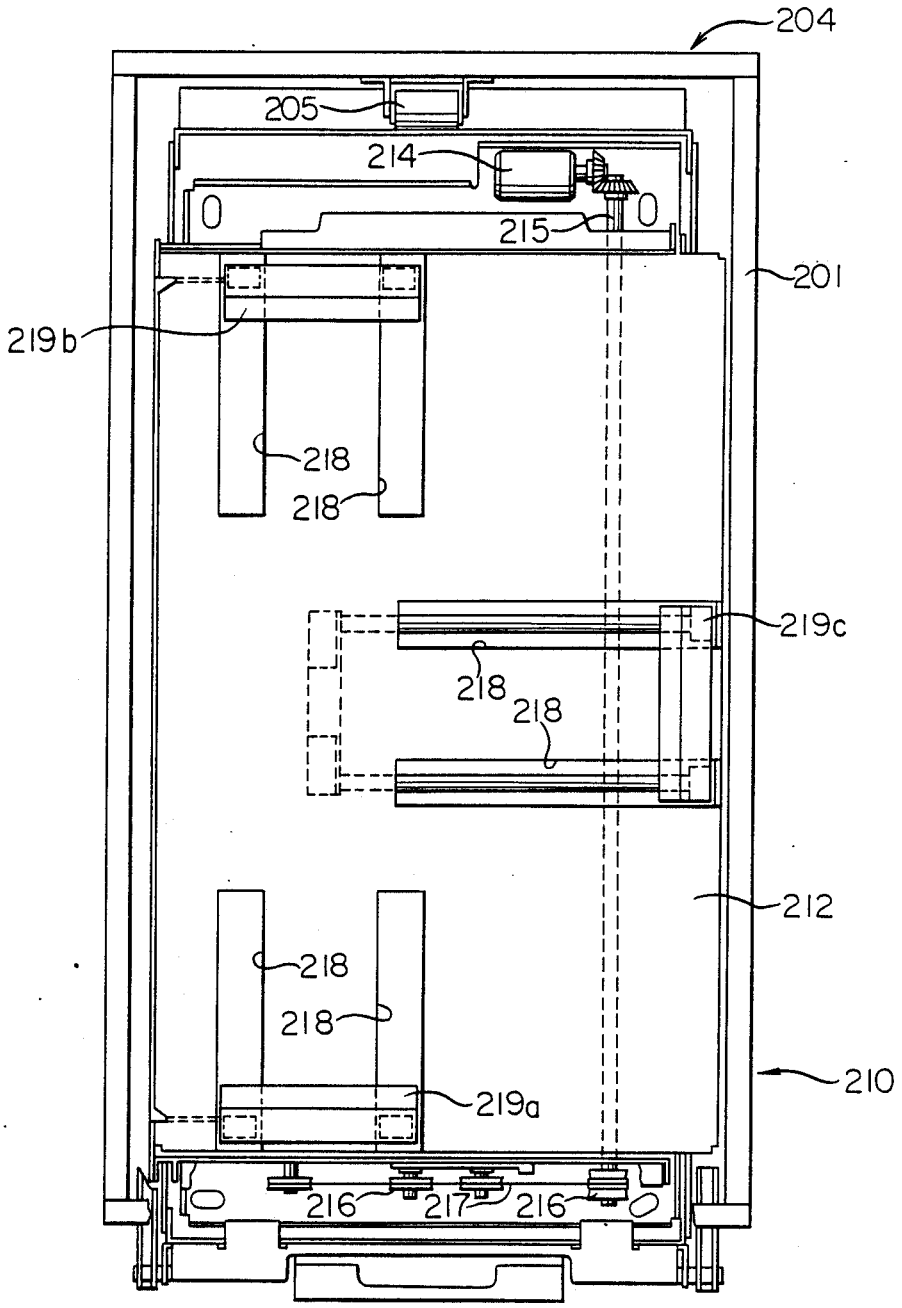
FIG. 12 is a simplified plan view of a sheet feeding unit in accordance with the present invention.
Figure 13:
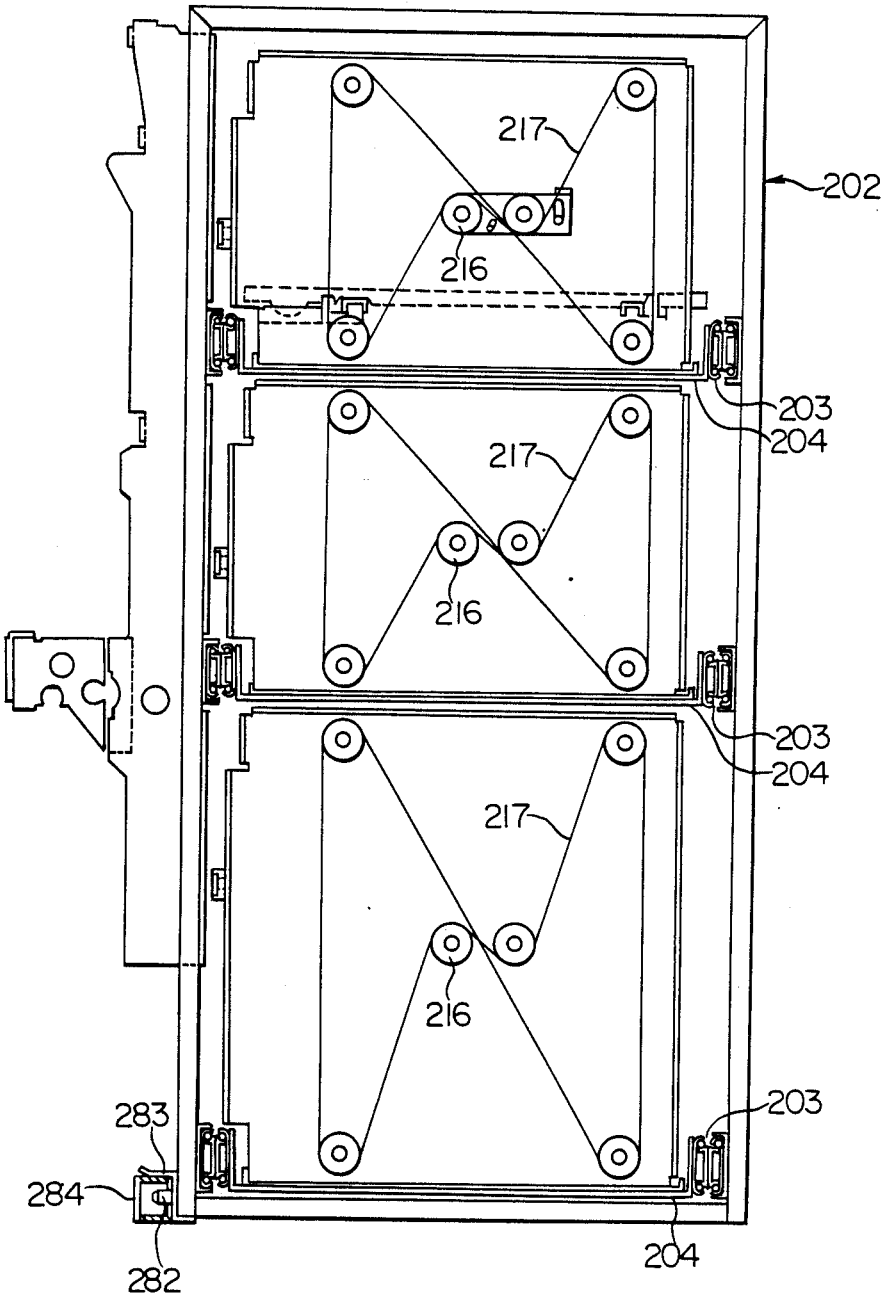
FIG. 13 is also a simplified front view of a sheet feeding unit in accordance with the present invention.
Figure 14:
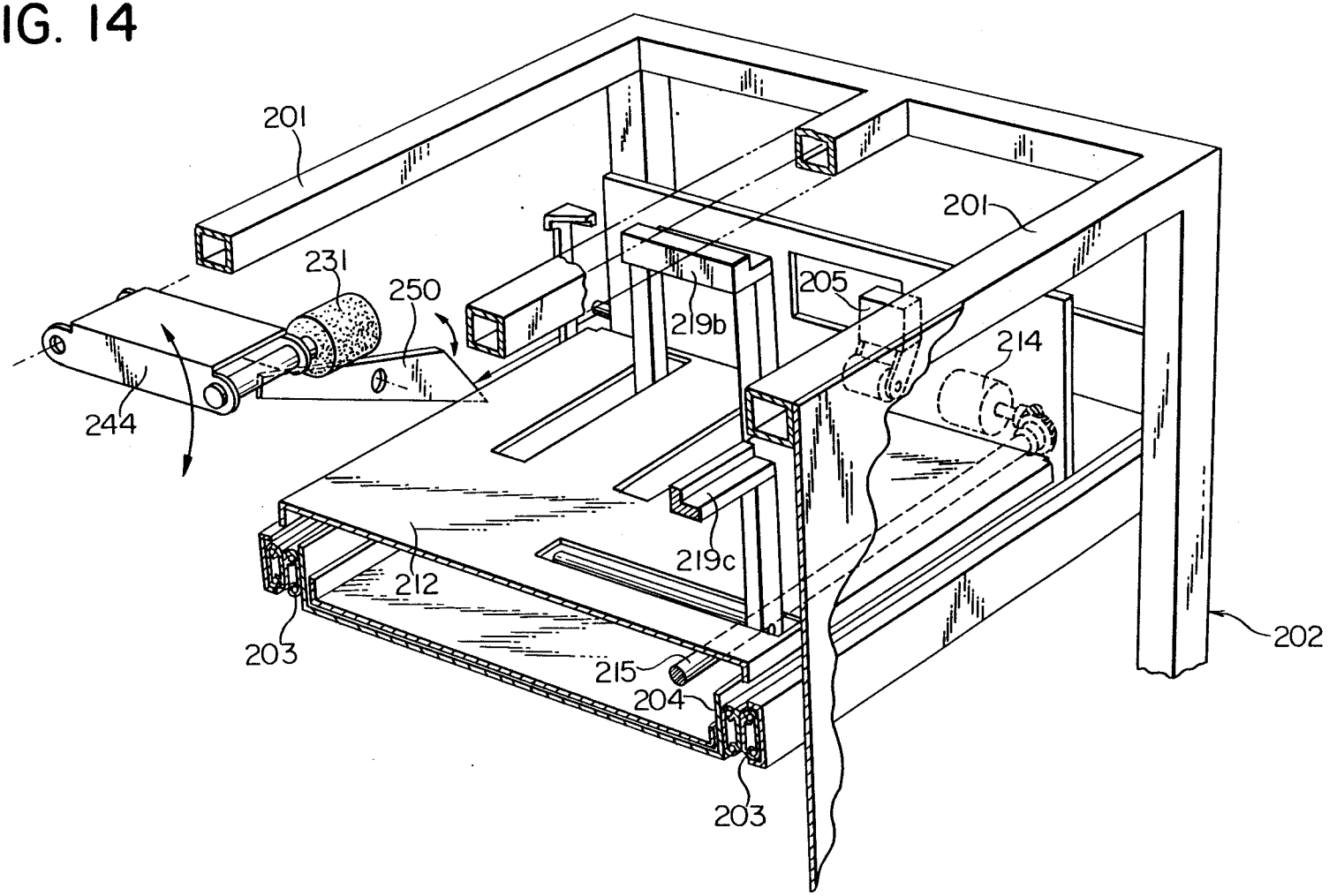
FIG. 14 is a simplified perspective view showing a partial cross section of the sheet feeding unit of the present invention.
Figure 15:
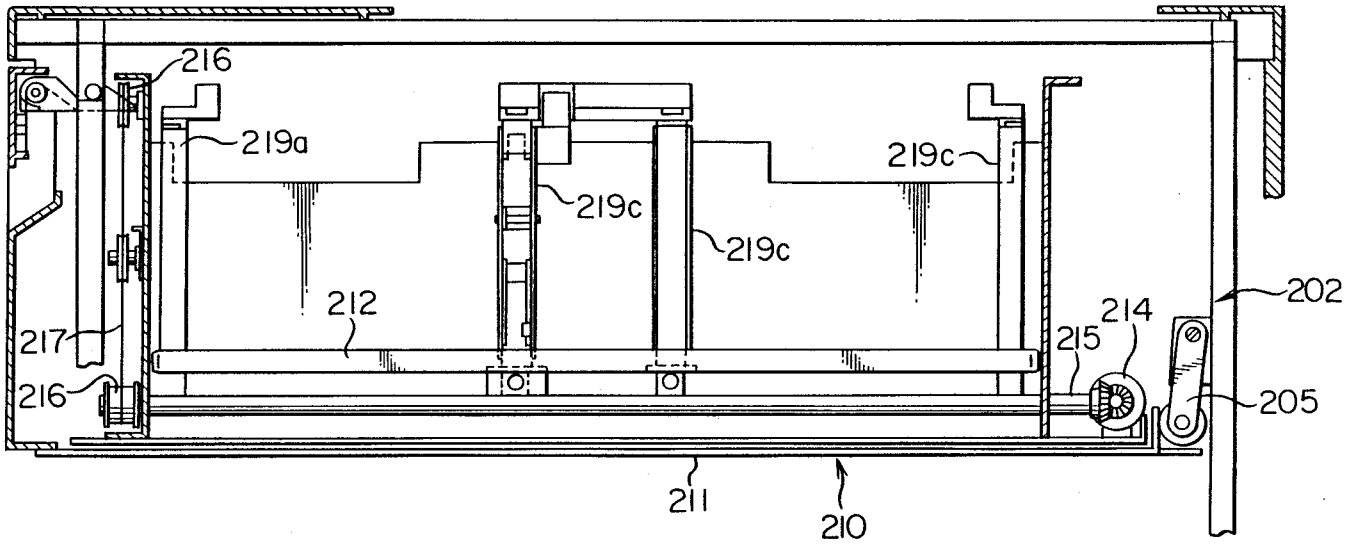
FIG. 15 is a simplified view of longitudinal section of the first stage of the sheet feeding unit of the present invention.

A lift unit 210 comprising a bottom plate 211 and a base plate 212 for carrying the sheets located above the bottom plate 211 is located on the plate 204 that is provided for each of the stages 205 as shown in FIG. 11.

The lift unit 210 comprises the flat bottom plate 211 supported with the tops of four embossed points 206 provided on the base plate 204, supporting plate 213 projecting towards both the near side and the far side of the bottom plate 211 and the lift base plate 212 interposed between the supporting plates 213. The lift base plate 212 is movable between the supporting plates 213 by means of the driving force from a driving source 214 installed on the bottom plate 211. The driving force is transmitted through a wire 217 extending on a plurality of pulleys and a shaft 215.

Figure 21:
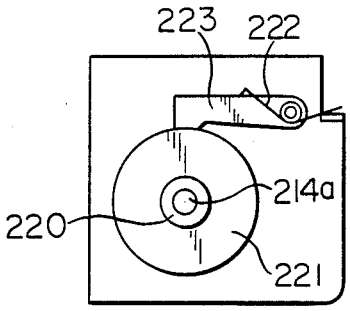
FIGS. 21 and 22 show the drive unit and stopping device of the drive unit, respectively.
Figure 22:
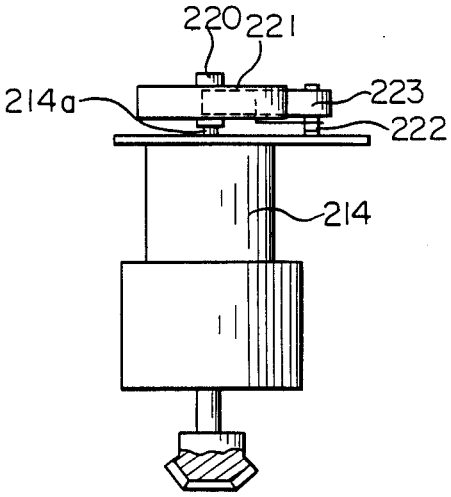

Furthermore, the drive source 214 for the up and down movement is provided in each lift unit 210 for enabling the up and down movement of the lift base plate 212 by the turn of the drive source 214. A pressure lever 223 that is loaded with a spring 22 is provided so that the pressure lever can be pressed against the circumferential surface of a pulley 221 that turns with a drive shaft 14a through a one-way clutch 20. Clutch 20 comes into contact with the drive source to apply the load thereto to stop the turn of the drive source 214 immediately when the movement of the lift base plate has stopped as shown in FIG. 21 and FIG. 22, whereby the lift base plate 212 can be prevented from stopping at the point deviating from the specified point due to the inertia, or the lift base plate 212 is made to stop at the specified point at the end of its up or down movement.

The lift base plate 212 has a rectangular hole 218 and three sets of arms 219a, 219b and 219c extending upwardly passing the rectangular hole 218. The arms 219a, 219b and 219c contact the front end and rear end of the stack of sheets placed on the lift base plate 212 of the lift unit 210 to regulate the position of the bunch of sheets on the lift base plate 212.

The lift unit 210 is mounted on the base plate 204 that is disposed on each of the upper stage, middle stage and lower stage of the frame 202 that constitute the body of the sheet feeding unit so as to be able to be drawn out horizontally towards the near side. In this case, as explained previously, the base plate has four embossed parts 6 on which the lift unit 210 rests. One of the four embossed parts 6 is provided with a screw passing through the bottom plate 211 of the lift unit 210 so that the lift unit 210 is able to move horizontally with respect to the screw without being displaced in the vertical direction and can be fixed to the base plate 204 at the desired position.

Figure 23:
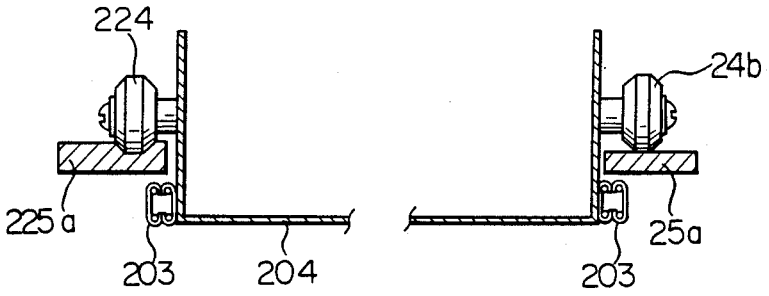
FIGS. 23 and 24 show the relationship between the roller and the frame mounted on the base plate, respectively.
Figure 24:
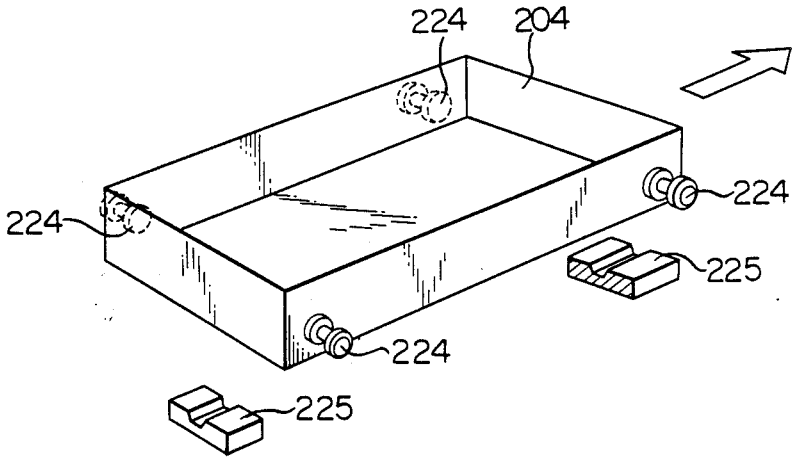

The base plate 204 can be drawn out horizontally by means of the rail member 203 which is provided between the frames and which has rollers 224 on both sides thereof as shown in FIGS. 23 and 24. The rails 225*a* and 225*b* for guiding the rollers 224 are installed on the frame 202.

More particularly, when the base plate that has once been drawn out is put back, the rollers 224 ride on the rails 225*a* and 225*b*. Of these rails 225*a* and 225*b*, the rail 225*a* which is located before the direction of the movement of the sheet has a form that almost coincides with the cross-sectional form of the roller 224. The rail 225*b* located behind the direction of the movement of the sheet has the form of a simple flat plate, so that the positioning of the sheet in the direction of movement is made by the rail 225*a*, and the vertical positioning is determined by the rail 225*b*.

Figure 25:
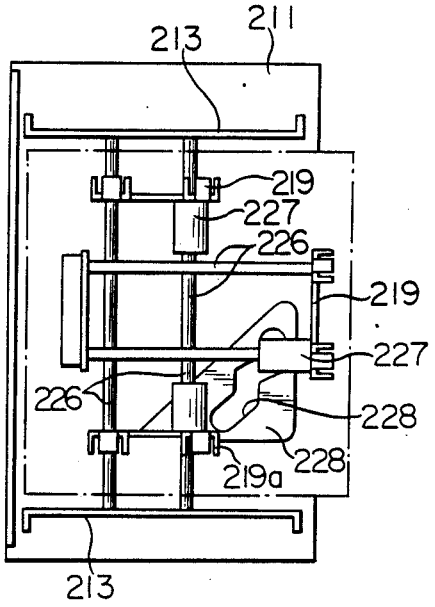
FIGS. 25, 26 and 27 show the relationship between the base plate of the lift and the arm, respectively.
Figure 26:
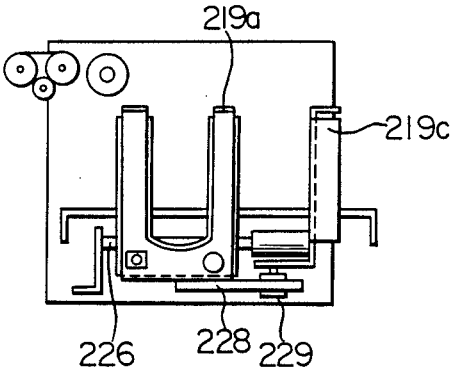
Figure 27:
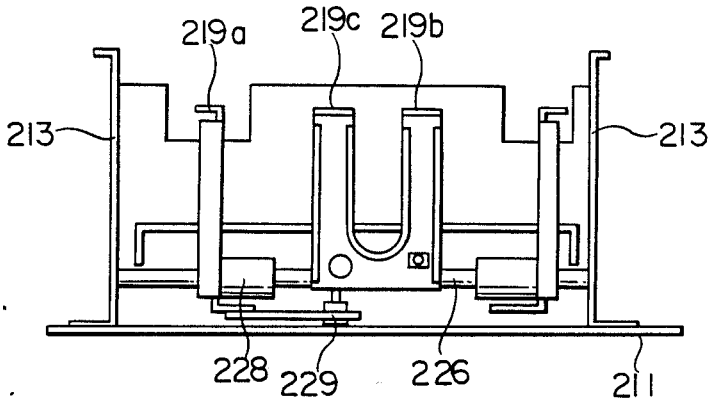

The arms 219*a*, 219*b* and 219*c* which contact the front, far end and rear end of the sheet respectively, to regulate the position of the sheet placed on the lift base plate 212 of the lift unit 210 are arranged so that the lower end of the arm 219*a* for the front end and the lower end of the arm 219*c* for the rear end cooperate with each other under the lift base plate 212 as illustrated in FIGS. 25, 26 and 27.

That is, a slide pipe 226 is installed orthogonally to the direction of the conveyance of the sheet at the lower end of the supporting plates 213 and 213. The supporting cylinder 227 slidably covers the slide pipe 226. The arm 219*a* for the front end and the arm 219*b* for the far end are connected to each other at their lower ends.

An interlocking cam 228 is installed on the front end arm 219*a* that is located under the lift base plate 212 for carrying the sheet. An interlocked roller 229 is located in a cam 228*a* of the interlocked cam 228. The interlocked roller 229 is used to shift the position of the rear end arm 219*c* that is installed on the supporting cylinder 227. The supporting cylinder 227 covers the slide pipe 226 that is provided in the same direction as that of the conveyance of the sheet under the lift base plate 212. Thus, when the front end arm 219*a* is moved along the slide pipe 226, this causes the interlocked cam 228 to move, and the interlocked roller 229 located in the cam 228*a* of the interlocked cam 228 moves simultaneously with the rear end arm 291*c*, since the roller 229 is attached to the rear end arm 219*c* that is movable in the same direction as that of the conveyance of the sheet under the lift base plate 212. That is, when the front end arm 219*a* moves towards the side of the far end arm 219*b*, the rear end arm 219*c* moves towards the direction of the conveyance of the sheet.

Thus, of the three arms 219*a*, 219*b* and 219*c* supporting the ends of the sheet, the arms 219*a* and 219*c* contact the two ends of the sheets or the front end and the rear end of the sheet.

The sheet feeding unit 230 consisting of the sheet feeding roller 31 for feeding the sheets on the lift base plate 212 of the lift unit 210 one by one from the uppermost sheet is installed on the left side of each of the upper stage, the middle stage and the lower stage of each frame.

Figure 28:
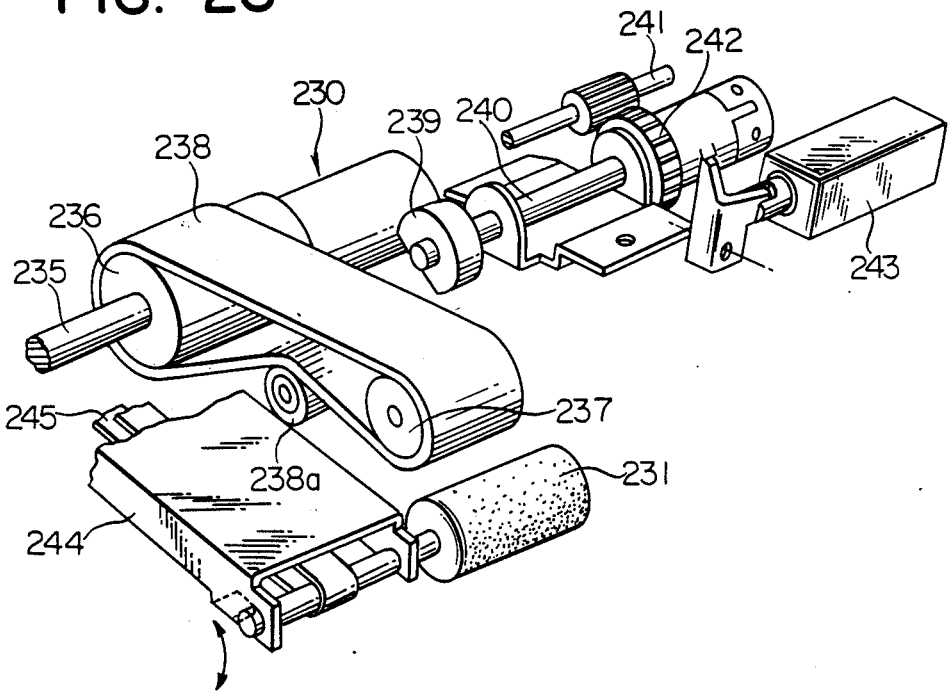
FIG. 28 shows the main parts of the sheet feeding unit of the present invention.

More particularly, each sheet feeding unit 230 is positioned with two pins a and b projecting at the far side of the frame 232 of the sheet feeding unit 230 with respect to the frame 202 of each sheet feeding apparatus, and the near side of the frame is fixed to the frame 202 with a screw 233. Also, as shown in FIG. 28, the essential part of the system comprises a shaft 235 which is turned by being driven, a roller 236 attached to the shaft 235, a duplicate feed preventive belt 238 extending between the roller 236 and another roller 237, a semicircular roller 239 in contact with the upper surface of the duplicate feed preventive belt 238, a one-way clutch 242 to transmit power between the shaft 40 of the semicircular roller 239 and the drive shaft 241 and a solenoid 243 to vary the transmission of the power by a one-way clutch 243. An arm member 244 that oscillates up and down is pivotally attached to the shaft 235 that is driven by the drive source. The sheet feeding roller 231 that is in contact with the uppermost one of the stack of sheets placed on the lift base plate 212 is pivotally installed o the front end of the arm member 244, so that the shaft 235 which is turned by the drive source and the sheet feeding roller 231 can be moved in cooperation with each other through the drive transmission member 245.

Also, the sheet feeding unit 230 having the above-described structure is detachably installed on each of the three stages of the frame 202 of the sheet feeding apparatus. One side of the sheet feeding unit 230 is provided with a lever 250 for locating the sheet feeding roller 31 at a higher position through the arm member 244 where the sheet feeding roller 31 is installed.

Figure 29:
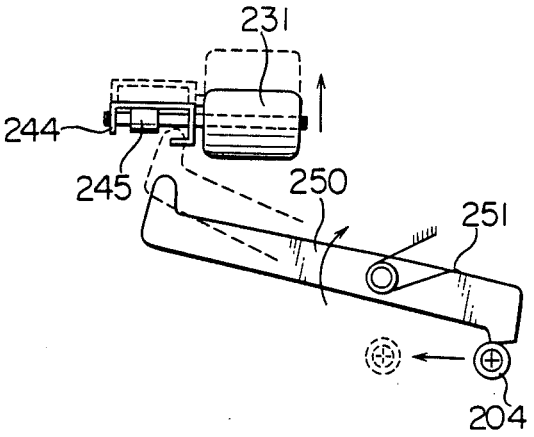
FIGS. 29 and 30 show the relationship of the base plate and the sheet feeding unit with the roller, respectively.
Figure 30:
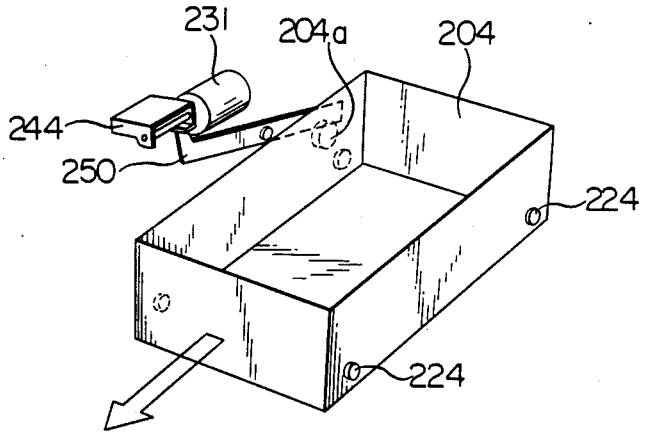

That is, as shown in FIGS. 29 and 30, one end of the lever 250 is spring-loaded with a spring 251, and this end can be brought to contact the bottom surface of the arm member 244. The other end of the lever 250 projects in the range of the frontward and backward movement of the base plate 204, upon which the lift unit 210 is mounted. Thus, when withdrawing the base plate 204 into the frame 202, one end of the lever 205 moves downwardly, since the roller 204*a* of the base plate 204 moves upwardly against the force of the spring 251, whereby the upward force acting on the arm member 244 is cancelled. Consequently, the sheet feeding roller 231 moves downwardly together with the arm member 244 to keep in contact with the upper surface of the sheet.

The left side of the frame is provided with a group of rollers constituting a sheet conveyance system for feeding the sheets sent out from the sheet feeding unit 230 consisting of three stages as described above to the copying apparatus A installed adjacent to the sheet feeding unit.

FIGS. 16 through 20 show the components constituting the conveyance system. Each sheet feeding unit 230 provided for each of the upper stage, the middle stage and the lower stage of the sheet conveyance system is operated by the drive source 261 of the drive system through the timing belt.

Figure 19:
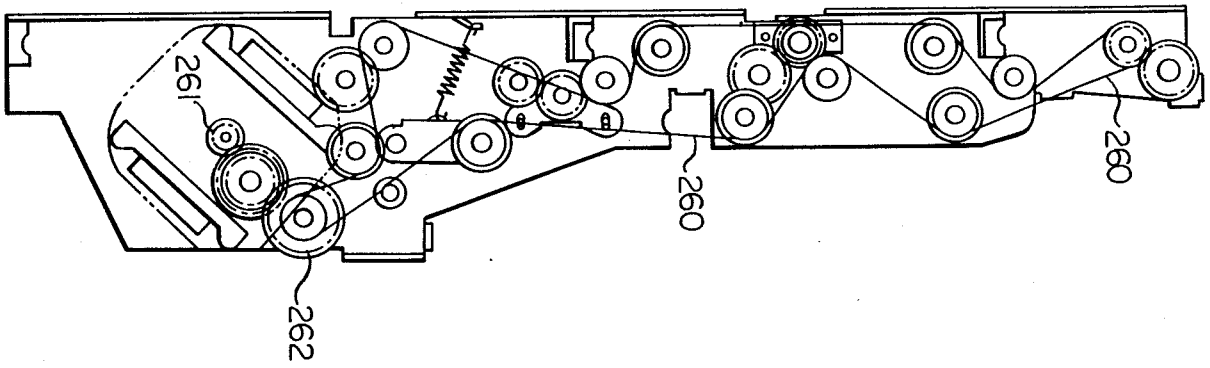
FIG. 19 is a front view of the sheet feeding unit of the present invention.
Figure 20:
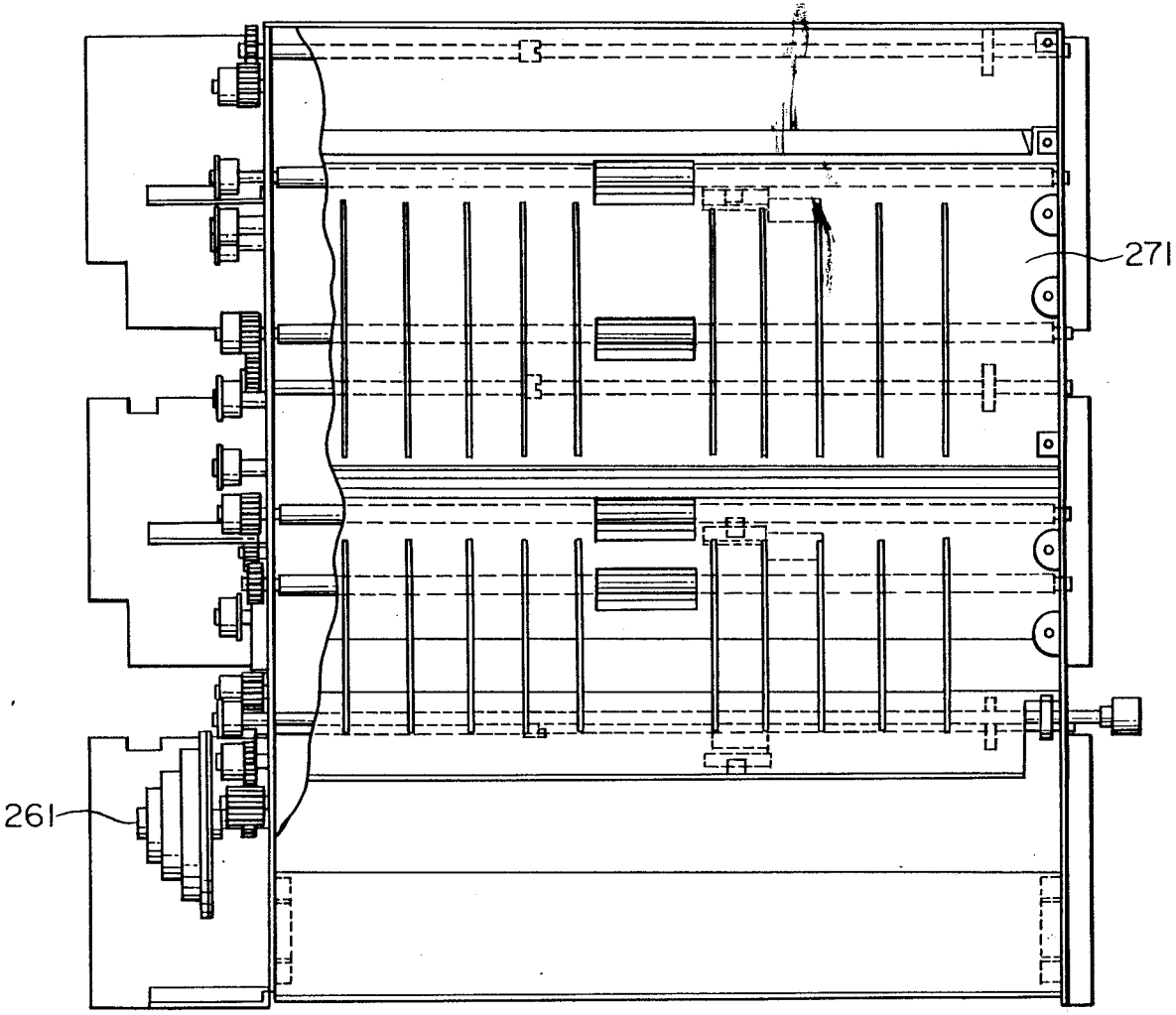
FIG. 20 is a further right-side view a sheet feeding unit of the present invention.

A plurality of gears are turned by the drive source 261 through the timing belt. As shown in FIGS. 19 and 20, the gears project to the left side of the body of the sheet feeding apparatus or to the position where the gears ar to be connected to the copying apparatus A. Of these gears, one gear 262 engages with the gear of the copying apparatus A when the sheet feeding apparatus is connected to the copying apparatus A. Also, though not shown in the drawing, the gear on the side of the copying apparatus is connected to a pair of upper and lower rollers. The pair of upper and lower rollers is located on the side of the image carrier of the copying apparatus rather than on the side of the sheet feeding roller 231 and is also coupled with a pair of upper and lower rollers located on the side of the sheet feeding apparatus rather on the side of the sheet refeeding roller i.e., the resist roller.

Thus, the driving power for the upstream side in the direction of the conveyance of the sheet is supplied by simply connecting the sheet feeding apparatus to the sheet feeding side of the copying apparatus.

Figure 16:
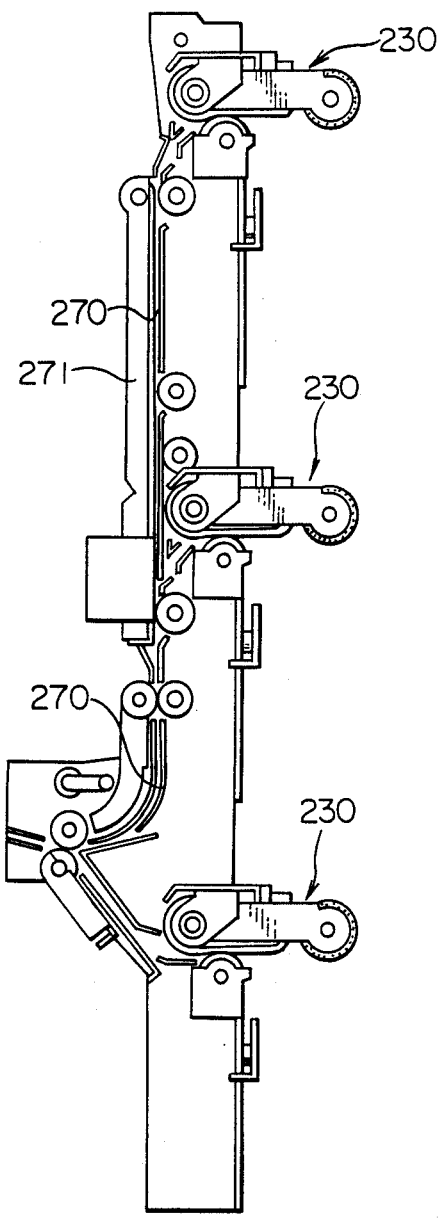
FIG. 16 is a front view of the sheet feeding unit of the present invention.
Figure 17:
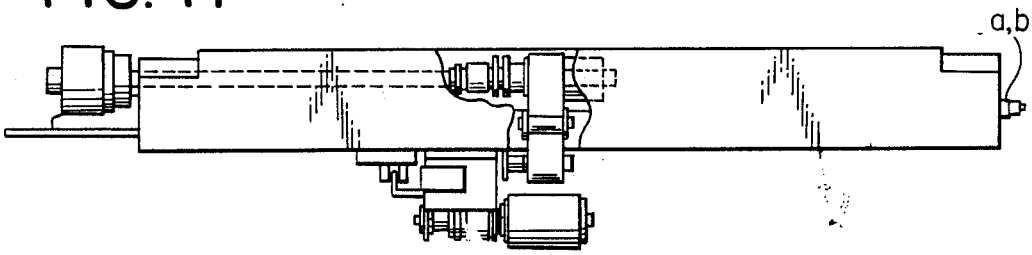
FIG. 17 is a plan view of the sheet feeding unit of the present invention.
Figure 18:
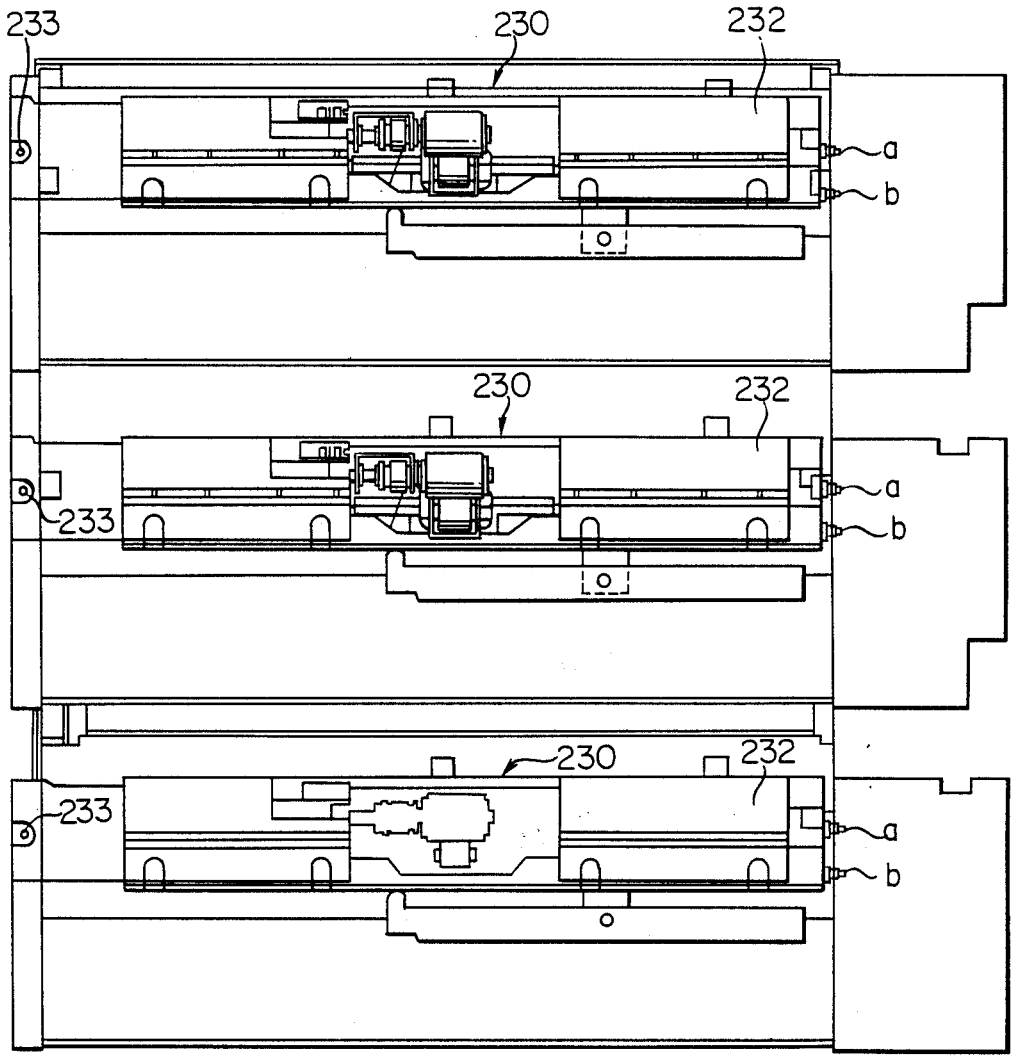
FIG. 18 is a right-side view of the sheet feeding unit of the present invention.

As shown in FIG. 16, the roller pairs for conveying the sheets discharged from each sheet feeding unit 230 ar provided in the conveyance route 270 extending from the sheet feeding unit installed on each stage of the sheet feeding apparatus to the pair of upper and lower rollers. Also, the rotary plate 271, whose upper end is pivotally installed, is provided between the roller pairs to prepare against the possible jamming of the sheets occurring between the roller during the conveyance of the sheets. Also, the conveyance route of the sheets is formed with the rotary plate, so that the conveyance route 270 can be opened by oscillating the rotary plate.

Figure 31:
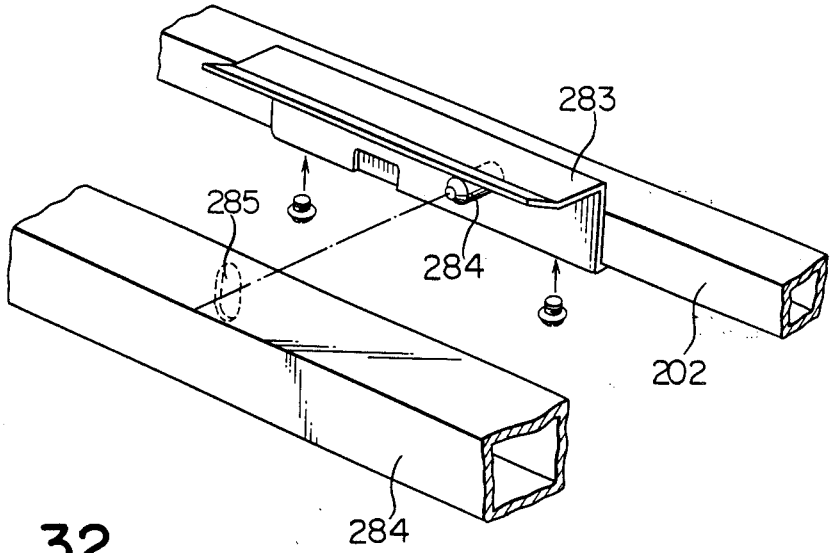
FIGS. 31 and 32 show the condition of the connection between the copying apparatus and the sheet feeder.
Figure 32:
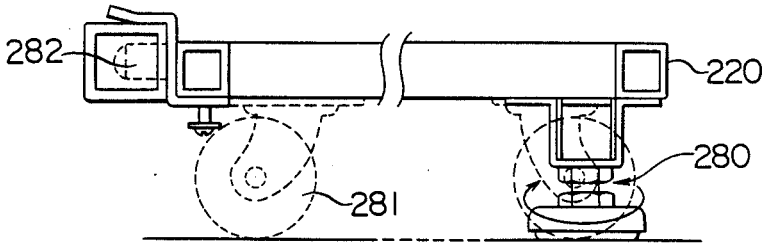
Figure 33:
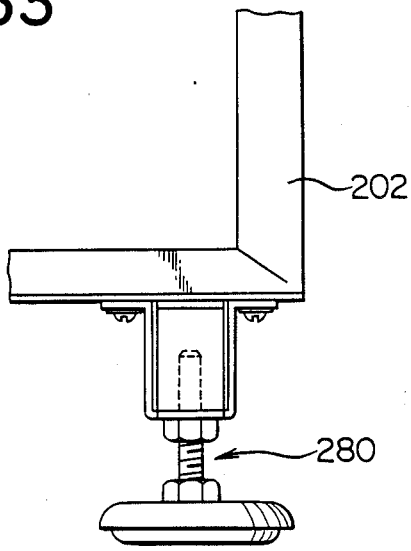
FIG. 33 is an enlarged view of the main part of the system shown in FIG. 32.

As shown in FIGS. 31, 32 and 33, adjusters 280 for adjusting the height of the body of the sheet feeding apparatus by either being projected or withdrawn are provided in addition to the coasters at two places, that is, the near side and the far side on the right side of the bottom of the frame constituting the body of the sheet feeding apparatus A coupling member 283 consisting of a pin 282 that contacts the bottom and the left end of the frame 202 and which has a top end that extends to the side of the copying apparatus and also a top end that extends slightly to contact the left end of said frame 202 is located at the middle of the left side of the frame 202. The coupling member 283 includes the pin 282 that can be inserted into a hole 285 provided in a square pipe 284 at the lower right end of the copying apparatus. A part that extends horizontally from the top end is capable of riding on the upper surface of the square pipe 284 of the copying apparatus. Thus, when the sheet feeding apparatus is set adjacent to the copying apparatus, and the coupling member 283 rides on the square pipe 284 of the copying apparatus, the positioning of the sheet feeding apparatus with respect to the copying apparatus can be determined under this condition.

In the case of the sheet feeding apparatus whose system is as described in the foregoing, a stack of sheets in the specified quantity should be placed o the lift base plate 212.

The sheet feeding apparatus is designed so that each of the upper-stage, the middle-stage and the lower-stage sheet feeding units can be drawn out when loading the sheets. However, drawing out these three sheet feeding units at one time can cause the center of gravity of the sheet feeding apparatus to be shifted towards the near side to fall down in the worst case, especially when the weight of the sheets is unevenly distributed, so that only one sheet feeding unit is allowed to be drawn out at a time.

Figure 34:
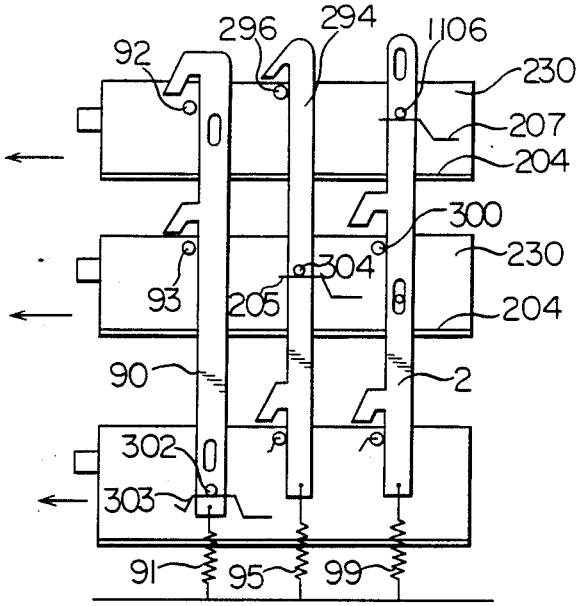
FIG. 34 shows the locking device of the base plate.

More particularly, as shown in FIG. 34, each of the base plates 204 of the sheet feeding units of the three stages is provided with a hooked arm on its side so that only one sheet feeding unit of one stage is allowed to be drawn out at a time due to the effect of the arm.

That is, as shown in FIG. 34, the left-side arm 290 is spring-loaded downwardly with a spring 291 and is provided with the hook capable of engaging with the pins 292 and 293 extending from the sides of the base plates 204 of the upper stage and the middle stage. The middle arm is spring-loaded downwardly by a spring 295 and is provided with the hooks capable of engaging with pins 296 and 297 extending from the sides of the base plates 204 of the upper stage and lower stage. The right-side arm 298 is spring-loaded downwardly by a spring 299 and is provided with hooks capable of engaging with pins 300 and 301 from the sides of the base plates 204 of the middle stage and the lower stage.

The rails 303 for releasing the pins 292 and 293 of the base plates of the upper stage and middle stage from their engagement with the hooks of arm 290 by coming into contact with the pin 202 of the arm 290 when the sheet feeding unit is withdrawn are provided at the sides of the bottom of the base plate 204. The rails 305 that release the pins 296 and 297 of the base plates 204 of the upper stage and the lower stage from their engagement with the hooks of the arm 294 by coming into contact with the pin 304 of the arm 294 when the sheet feeding unit is withdrawn are provided at the sides of the middle-stage base plate 204. Furthermore, rails 307 are provided on the sides of the upper-stage base plate 204 so that the pins 300 and 301 of the base plates of the middle stage and the lower stage can be released from their engagement with the hooks of the arm 298 while the rails 307 are in contact with the pin 306 of the arm when the sheet feeding units are withdrawn.

Thus, the sheet feeding apparatus is completely free of the possibility that the base plates of the upper, the middle and the lower stages are drawn out all at once.

Figure 35:
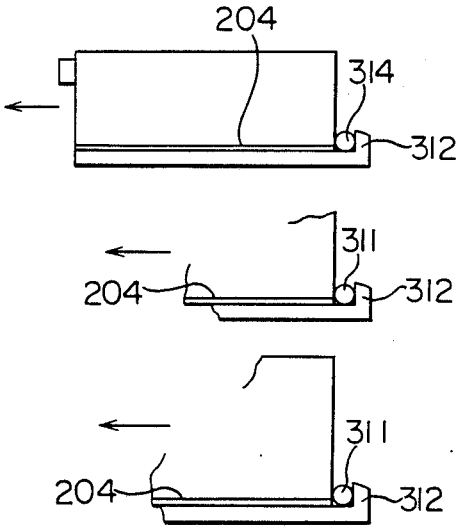
FIGS. 35 and 36 show another embodiment of the device shown in FIG. 34.
Figure 36:
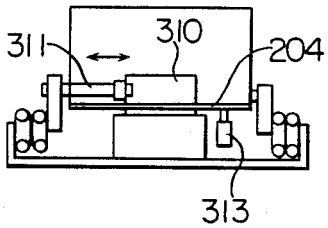

Furthermore, as shown in FIGS. 35 and 36, the sheet feeding apparatus according to the present invention may be designed without the arms 290, 294 and 298 by using a solenoid 310 to project and retract a lock pin 311 for enabling the lock pin 311 to engage with a guide 312 for locking provided on the base plate 204 in order to prevent the base plate 204 from moving. In this system, the base plate drawn out is detected by a microswitch 313 to determine whether the solenoid is to be actuated or not.

Figure 41:
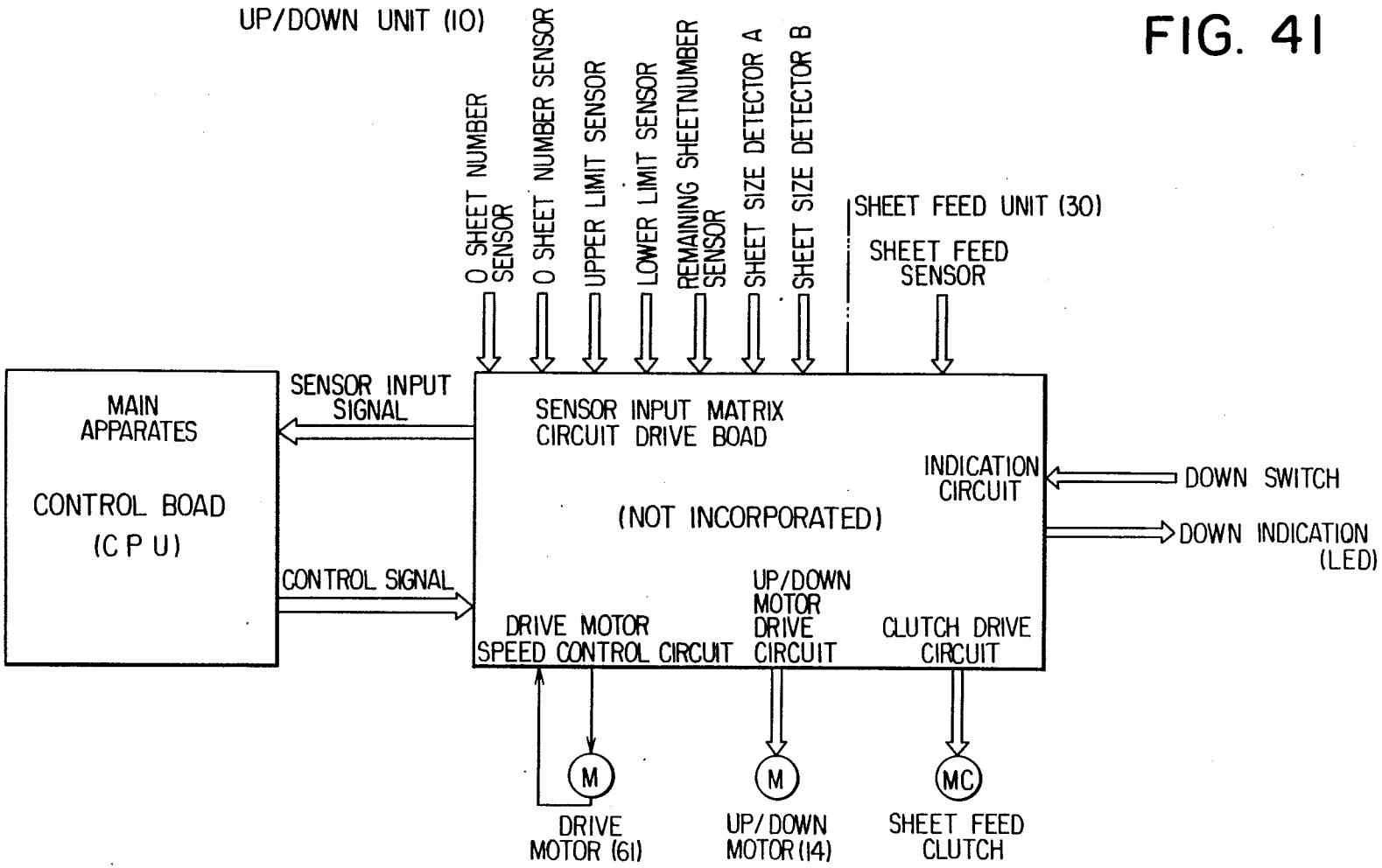
FIG. 41 is a block diagram of the whole system of the present invention.

FIG. 41 shows a block diagram of the whole control circuit for driving the sheet feeding apparatus B designed as described in the foregoing. The drive circuit board of the sheet feeding apparatus B not including the central control circuit consists of a sensor matrix input circuit, an LED display circuit, a clutch drive circuit, a tray lift motor drive circuit and a drive motor speed control circuit. The sensor matrix input circuit receives the input of the signals of the unit set detector, the zero-sheet detector, the upper limit detector, the lower limit detector, the sheet remainder detector and two sheet size detectors which are provided in the lift unit 210 corresponding to the three sheet feeding units. Furthermore, the sensor matrix circuit is connected to the feed sheet detector for the three sheet feeding units 230, the down switch of each lift unit 210 and the down LED.

The drive motor speed control circuit of the sensor matrix input circuit is connected to the drive motor 261. The tray lift motor drive circuit is connected to the lift motor 214. The clutch drive circuit is connected to the feed sheet rack.

As for the sensor matrix circuit with the above-described connections and the main unit control circuit board including the central control circuit, the sensor input signal is inputted to the main unit control circuit board from the sensor matrix circuit. The control signal is inputted to the sensor matrix circuit from the main unit control circuit board.

The operations of the above-described various parts will be explained in the following. Each of the sheet feeding units 230 is capable of carrying more than 1000 sheets. To load the sheet feeding unit with the sheets, the sheet feed unit upon which the sheets are to be loaded is drawn out. The arm 219*b* located at the far end is adjusted to the size of the sheets. The stack of sheets is then placed so that its ends are brought to contact the arm 219*b* located at the far end of the sheet feeding unit and the front-end, i.e. the left-side end of the sheet feeding unit. Then the arms 219*a* and 219*c* are brought into contact with the near end and the rear end, i.e., the right-side end of the sheets, in order to regulate the position of the stack of sheets on the lift base plate 212.

The lift base plate 212 automatically ascends when it detects the presence or absence of the sheet so that the uppermost one of the sheets comes into contact with the sheet feeding roller 213 of the sheet feeding unit 230. The level of the uppermost sheet will vary as the sheets are sent out one by one, and the lift base plate 212 ascends automatically.

When the sheets on the lift base plate 212 have run out, the absence of the sheets is detected to cause the lift base plate 212 to descend, and the lamp lights to tell the operator of the absence of the sheets.

The sheets are sent out by the sheet feeding roller 231, which turns intermittently according to the instruction from the copying apparatus to send out the sheets one by one.

It is desirable for the sheets to be sent out one by one but sometimes a plurality of sheets are sent out at a time.

The plurality of sheets sent out at a time are led to the duplicate feed preventer i.e., separator that is a sheet feeding unit 230 detachably installed to the frame 202 where the sheets are separated so as to be sent out one by one without fail.

The separator may be designed according to any method, but in the case of the sheet feeding apparatus according to the present invention, the separator uses the duplicate feed preventive belt 238 and the stop roller in order to differentiate the conveyance speed for the upper surface of the sheet from that of the back of the sheet for assured separation of the sheets.

Each sheet separated from the stack of sheets proceeds on the conveyance route 270 to the sheet refeeding roller, i.e., the resist roller, installed in the frame of the copying apparatus without being interrupted, stops there once in order to have its bend corrected, if any, and resumes to proceed timing to the control signal on the side of the copying apparatus.

The above processes are designed so that the sheet can be supplied by each sheet feeding unit 210 by the same processes. Even when all the sheet feeding units except one are in operation according to the instructions from the copying apparatus, the sheet feeding unit 210 not in the use can be drawn out for replenishing or changing the sheets without interrupting the progress of the copying operation.

When jamming has occurred in supplying the sheet to the sheet feeding unit 210, the sheet feeding unit 210 descends automatically for easier removal of the jammed sheets. In removing the jammed sheets, the rotary plate 271 provided in the conveyance route 270 further facilitates the removal of the jamming in the conveyance route 270.

Each sheet feeding unit 210 is provided with its own independent lift drive motor 214, but all the sheet feeding units may be driven with one drive motor through the clutch.

In the sheet feeding system, a motor 261 is provided for the conveyance route 270 located after the sheet feeding unit 230 and the separator. The sheet feeding unit 230 is driven through the clutch.

The timing for sending out the sheets is dependent on the signal from main unit. The sheets are sent out intermittently, and the conveyance speed of the sheet can be synchronized with any speed depending on the speed set by the main unit.

Figure 42:
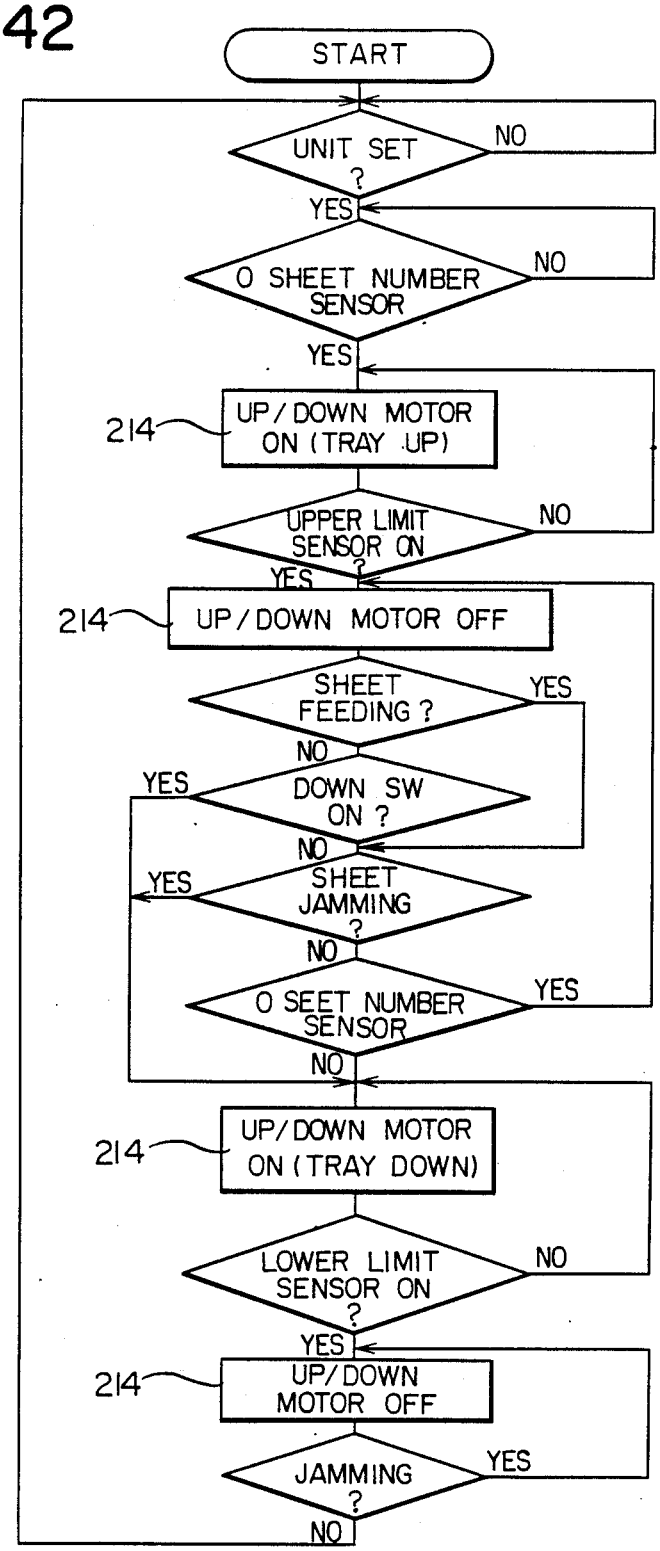
FIG. 42 is a flow chart showing the movement of the lift unit.

The driving process of the lift unit is as shown in the flow chart of FIG. 42. When the stack of sheets is set, the presence of the sheets is detected by the zero-sheet detector. This detection causes the lift motor to be actuated, whereby the lift base plate 210 ascends. When the uppermost surface of the sheets has reached the upper limit, this is detected by the upper limit detector to stop the ascending of the lift base plate. The operator will not depress the down switch unless the system is in the sheet supplying process, and the zero-sheet detector detects the presence of the sheets unless there is jamming of the sheets. Consequently the sheet feeding unit 230 operates while the lift motor 214 remains stopped.

When the supply of the sheets is in progress, or when the down switch has been depressed by the operator, or when there is jamming of the sheets the lift motor 214 ascends, and when its ascension to the lower limit is detected by the lower limit detector, the lift motor 214 stops, and the motor remains stopped if the jamming of the sheets still exists, even when the lift motor has descended to its lower limit.

Figure 43:
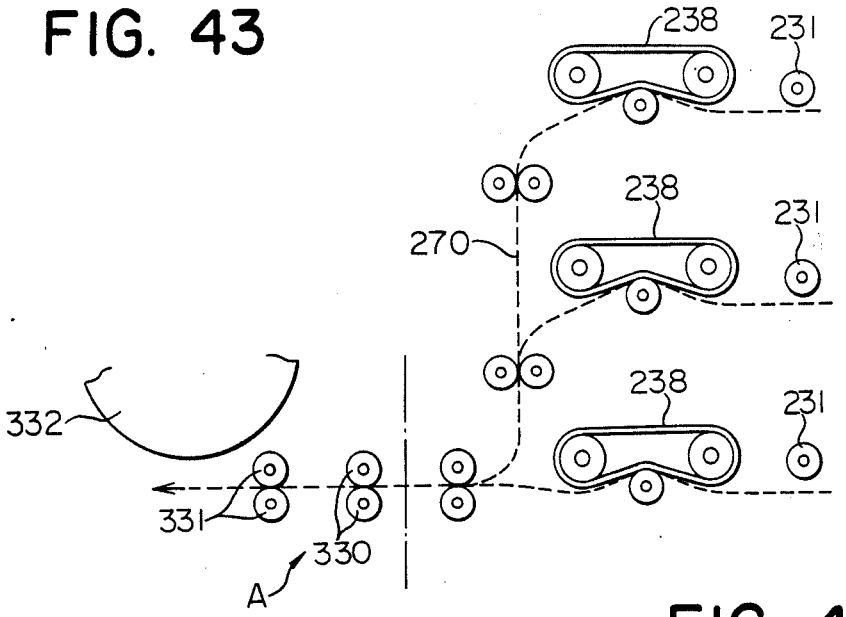
FIG. 43 is a simplified view of the part that operates continuously when the sheet feeder and the copying apparatus are connected to each other.

FIG. 43 shows the parts of the sheet feeding apparatus and the copying apparatus which cooperate with each other in conveying the sheets. These part comprise the sheet feeding roller 231 of each sheet feeding unit located above the three-stage lift unit 210, the duplicate feeding preventive belt 238 of the sheet feeding unit 230 provided in each stage and a plurality of rollers provided the conveyance route 270 of the sheets carried by the duplicate feeding preventive belt and discharged from the sheet feeding apparatus. These parts further comprise a sheet feeding roller 1230 of the copying apparatus A, a restart roller 1231 and an image carrier 332. The speeds of the sheet feeding roller 313, the roller of conveyance route 270, the sheet feeding roller 330 of copying apparatus A and the restart roller 331 are equalized. Also, the conveyance speed of the sheets by the duplicate feeding preventive belt 238 is made equal to the above speeds.

The conveyance speed of the sheets by the duplicate feeding preventive belt 238, however, tends to be reduced due to the slip occurring between the sheet and the belt where the conveyance speed is merely equalized to that of aforementioned parts, so that the conveyance speed of the belt 238 is set 25% to 30% higher than that of the sheet feeding roller 231.

By taking the measures as described above, the conveyance process can be free of jamming of the sheets, even when there are sheets in succession in the conveyance route 270. Also, when the speed is equalized to the circumferential speed of the image carrier 332, the timing of sheet feeding need not be changed, even when the circumferential speed of the image carrier has to be changed due to the change of the magnification of the image, whereby stable feeding of the sheet can be maintained.

Figure 44:
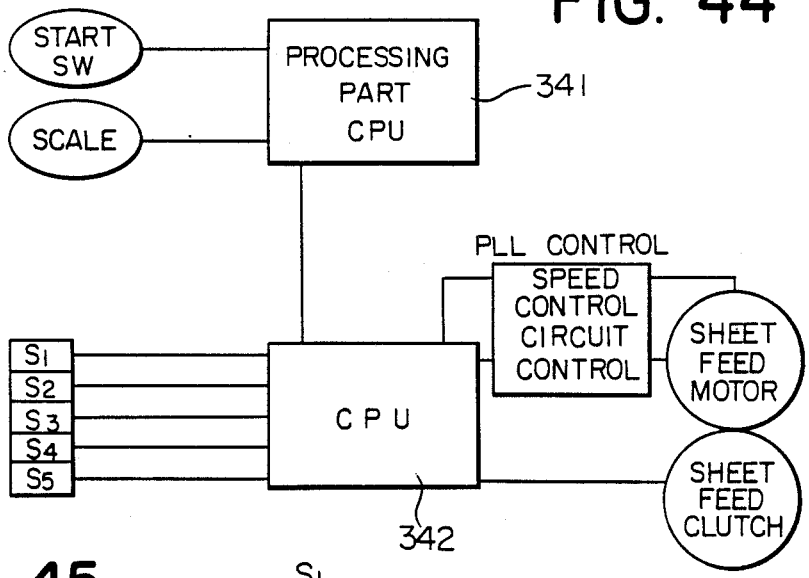
FIG. 44 shows the relationship between the operating unit and processing unit in the copying apparatus.
Figure 45:
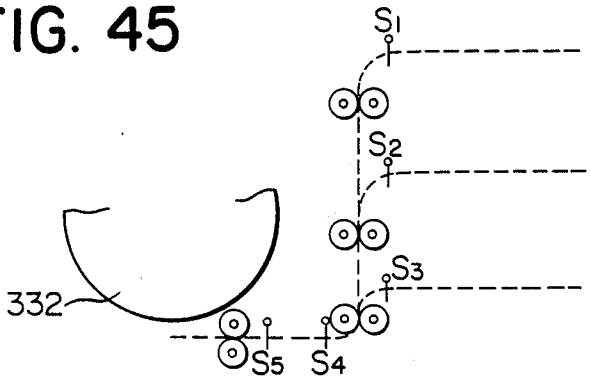
FIG. 45 shows the location of the sensor in the part shown in FIG. 43.

As shown in FIG. 44, the start signal and the magnification setting signal are inputted to the operation panel 340 of the copying apparatus A. The operation panel is connected to the processing unit (CPU) 341. As shown in FIG. 45, the processing unit (CPU) 342 is connected to the processing unit (CPU) 341 and is also connected to various sensors located in the sheet feeding unit 210 and the conveyance route of the copying apparatus A, that is, the sheet feeding sensors S1, S2, S3, the intermediate sensor S4 in the conveyance route of the copying apparatus and the sheet refeeding sensor S5. Also, the processing unit (CPU) 342 is connected to the sheet feeding motor for driving the duplicate feeding preventive belt 23 and the sheet feeding roller 231 and the sheet feeding clutch for transmitting the drive force of the sheet feeding motor.

Figure 46:
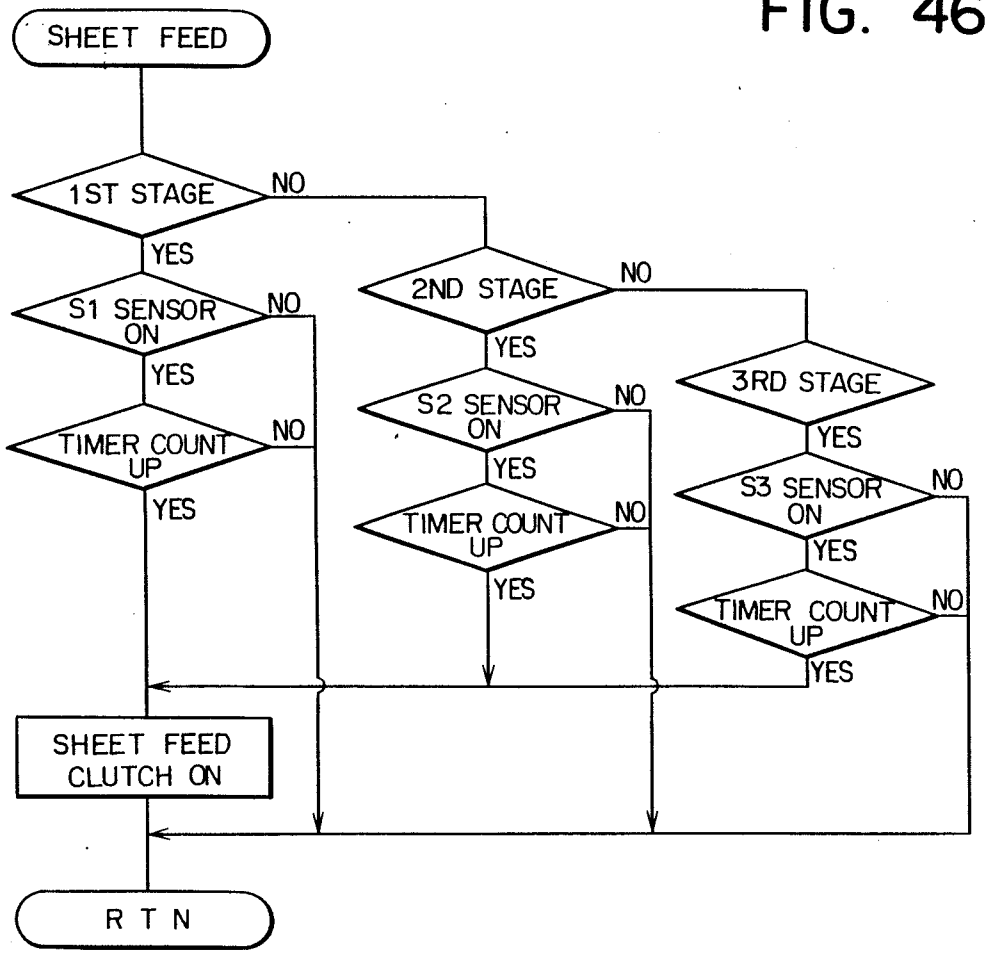
FIG. 46 is a flow chart showing the process of the transmission of power by the operating unit and each sensor at the time of sheet feeding operation.

As shown in FIG. 46, when feeding sheets to the copying apparatus from the sheet feeding apparatus, the operation unit of the copying apparatus is first instructed of the stage from which the sheets are to be supplied, whereby the timer counter is set through sheet feeding sensor S1 for the conveyance of the sheets. The sheet feeding clutch is then actuated to transmit the drive force of the sheet feeding motor, and only the setting of the timer is performed.

In the case of the conventional sheet feeding apparatus having the above-described mechanism, when the rear end of a sheet has left the sheet refeeding roller, the succeeding sheet from the feed sheet cassette is sent to the waiting position of the sheet at a high speed by the sheet refeeding roller. In the case of the sheet feeding apparatus according to the present invention, however, the sheet is fed at a speed equal to or higher than the sheet feeding speed of the sheet refeeding roller.

When the control of the speed in sending out the sheet the sheet carrier, including the control of the stopping of the sheet, is lacking, there is the possibility that the succeeding sheet will run into the preceding sheet at the restart stage, thereby causing the fall of the restart accuracy. However, where the high speed control system is available, the feeding speed can be reduced compared to that in the case of the conventional system, and this enables the feeding speed to be equalized to that of the process speed.

According to the present invention, not only the reliability of the sheet feeding operation can be improved, but also reduction of no feed, multifeed and jamming in the conveyance process and improvement in the sheet conveyance efficiency can be realized by designing the sheet feeding system as described in the foregoing.

Furthermore, the sheet feeding system according to the present invention enables the intervals of the preceding sheets and the succeeding sheets to be equalized or increased, so that no allowance is required for the sheet conveyance time. Thus, the sheet can be conveyed in succession, whereby the high-efficiency processing (high CPM) can be realized even where the conveyance speed is relatively low.

Furthermore, in the case of a conventional high-speed copying apparatus, when the sheet is sent out from the sheet refeeding roller, the succeeding sheet has to be sent to the restart position at a high speed. In the case of the system according to the present invention, however, the processing at a high speed can be made readily, even when the distance between the image carrier of the copying apparatus and the sheet feeding apparatus is relatively large.

The explanation of the above-described embodiment is directed to the case where the sheet feeding system is located on the sheet feeding side of the copying apparatus A, but the sheet feeding system according to the present invention is not limited to this case. For instance, the sheet feeding system according to the present invention may be connected to other systems requiring other sheets such as a printer, a press and a facsimile.

The sheet feeding system according to the present invention designed as described in the foregoing enables separation of the sheet feeding apparatus from the copying apparatus. As a result, the combination of the sheet feeding apparatus with the copying apparatus can be changed freely depending on the variation of the requirement for the quantity of the sheets to be loaded. Furthermore, the sheet feeding apparatus is independent of the frame of the copying apparatus, so that packing for shipment can be facilitated. In addition, the expansion of the variety of the sheet size and the increase in the sheet loading capacity can be realized by increasing the overall dimensions of the sheet feeding apparatus, which lead to reduction of the frequency in the replenishment of the sheets and realization of the continuous large-quantity copying. Besides, a dehumidifying heater can be installed in the sheet feeding apparatus to keep the sheets in satisfactory condition at all times to enable sheet feeding operation under desirable conditions.

Additional advantages and modifications will readily occur to those skilled in the art. The invention in its broader aspects is therefore, not limited to the specific details, representative apparatus and illustrative examples shown and described. Accordingly, departures may be made from such details without departing from the spirit or scope of the general inventive concept as defined by the appended claims and their equivalents.

What is claimed is:

1. An electrophotographic copying machine comprising:

at least one sheet tray for holding a plurality of sheets;

a light source for generating exposure light;

a photoreceptor for receiving a toner image;

scanning exposure means for scanning the exposure light onto a document to be copied, and for forming an image of the exposure light reflected from the document onto the photoreceptor, said scanning means performing the scanning operation for each of the plurality of sheets;

means for moving said photoreceptor at a predetermined line speed;

registration means disposed along said sheet path for transporting a sheet to said photoreceptor with a registration timing so that a toner image disposed on the photoreceptor is transferred onto the sheet;

transport means disposed along said sheet path for transporting a sheet to said registration means;

feed means disposed along said sheet path for feeding a sheet out of said sheet tray to said transport means, at a desired feed timing;

means for coordinating the sequential operation of said feed means, said transport means and said registration means to transport the sheet at a speed equal to said line speed of said photoreceptor so that a plurality of sheets serially fed out by said feed means are concurrently transported along said sheet path;

timing means for generating a timing reference signal in response to the scanning operation of said scanning exposure means; and control means for controlling the feed timing of said feed means and the registration timing of said registration means in response to the timing reference signal of said timing means so that said feed means feeds a sheet out of said sheet tray in response to the timing reference signal generated in response to the scanning operation for a previously fed out sheet, said control means including an initial timing means for supplying the timing reference signal before a predetermined number of sheets are fed to said sheet path at an initial stage of continuous copy operation.

2. The electrophotographic copying machine of claim 1, wherein said transport means further comprises an intermediate tray for storing a pile of one side copied sheets; a refeed member for refeeding the one side copied sheets from said intermediate tray to said photoreceptor, and wherein the one side-copied sheet is conveyed from said intermediate tray to said photoreceptor in the speed substantially equal to the line speed of said photoreceptor.

3. The electrophotographic copying machine of claim 1, wherein said sheet tray is adapted to move up and down, thereby taking at least two positions of which one is a working position for feeding the sheet therefrom and another one is a rest position for replenishing the sheet therein.

4. The electrophotographic copying machine of claim 3, wherein said sheet tray has the working position at up position where the uppermost sheets of the pile of sheet stored in said sheet tray come in contact with said feed means.

5. The electrophotographic copying machine of claim 4, wherein said feed means comprises a double feed prevention mechanism for feeding the sheet one by one.

6. An electrophotographic copying machine as claimed in claim 1, wherein said scanning exposure means has a carriage capable of moving reciprocatively along a document, and wherein said timing means includes a position sensor for detecting the reciprocative movement of said carriage.

7. An electrophotographic copying machine as claimed in claim 6, wherein said position sensor detects the passage of said carriage past a predetermined point and then generates said timing reference signal.

8. An electrophotographic copying machine as claimed in claim 1, wherein the previously fed out sheet is the leading sheet among the plurality of sheets along said sheet path.

9. An electrophotographic copying machine as claimed in claim 1, wherein said at least one sheet tray includes a plurality of sheet trays, each of said plurality of sheet trays having a sheet path of a unique length, said fed means including a plurality of feed rollers associated with said plurality of sheet trays, and said control means including timing adjusting means for adjusting the feed timing of said feed roller in proportion to the difference in path length of said sheet trays.

10. The electrophotographic copying machine of claim 9, wherein said timing adjusting means is a timer.

* * * * *